US007909168B2

(12) United States Patent
Virvo

(10) Patent No.: US 7,909,168 B2
(45) Date of Patent: Mar. 22, 2011

(54) SLIDE AND LOCK DISPLAY SYSTEM

(76) Inventor: Alexander Virvo, Stamford, CT (US)

( * ) Notice: Subject to any disclaimer, the term of this patent is extended or adjusted under 35 U.S.C. 154(b) by 547 days.

(21) Appl. No.: 12/002,501

(22) Filed: Dec. 17, 2007

(65) Prior Publication Data

US 2008/0236002 A1 Oct. 2, 2008

Related U.S. Application Data

(60) Provisional application No. 60/875,225, filed on Dec. 16, 2006.

(51) Int. Cl.
*B65D 5/52* (2006.01)
*B65D 25/24* (2006.01)

(52) U.S. Cl. ..... 206/745; 206/45.25

(58) Field of Classification Search ..... 206/1.5, 206/45.24, 45.25, 730, 731, 745, 758, 764; 40/661.08, 672; 211/70.1, 72, 73; 220/8; 229/125.125

See application file for complete search history.

(56) References Cited

U.S. PATENT DOCUMENTS

| | | | | |
|---|---|---|---|---|
| 2,253,742 | A * | 8/1941 | West et al. | 221/52 |
| 2,627,972 | A * | 2/1953 | Roos | 206/731 |
| 3,918,576 | A * | 11/1975 | Taub | 206/764 |
| 4,191,288 | A * | 3/1980 | Hostad | 206/764 |
| 4,284,204 | A | 8/1981 | Carey, Jr. | |
| 4,705,162 | A * | 11/1987 | Kupersmit | 206/745 |
| 6,641,031 | B2 * | 11/2003 | Evans et al. | 229/125.125 |
| 6,837,378 | B2 * | 1/2005 | Mason et al. | 206/745 |

OTHER PUBLICATIONS

PCT/US2007/025761, "PCT International Search Report and Written Opinion", Jun. 25, 2009, 8 pages.

* cited by examiner

*Primary Examiner* — Luan K Bui
(74) *Attorney, Agent, or Firm* — Hoffman Warnick LLC

(57) ABSTRACT

A disposable shippable display apparatus for use in displaying products, samples, premiums, messages or the like comprises an inner sleeve containing products, samples, or the like, slidably located within an outer sleeve and configurable between a closed or an open position. After shipping the display apparatus to its end destination in the closed position the display is easily and quickly user deployed by moving the inner sleeve to the open position, where multiple catches and supports lock the inner sleeve in an immediately useable display configuration. The products and samples are now in full view for consumption by patrons and customers.

17 Claims, 39 Drawing Sheets

FIG 1A
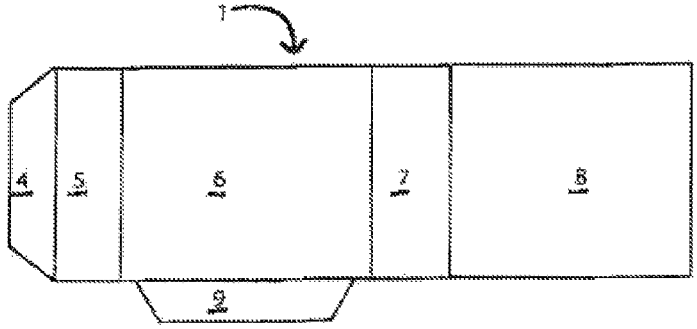
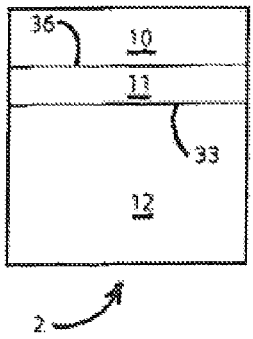
FIG 1B
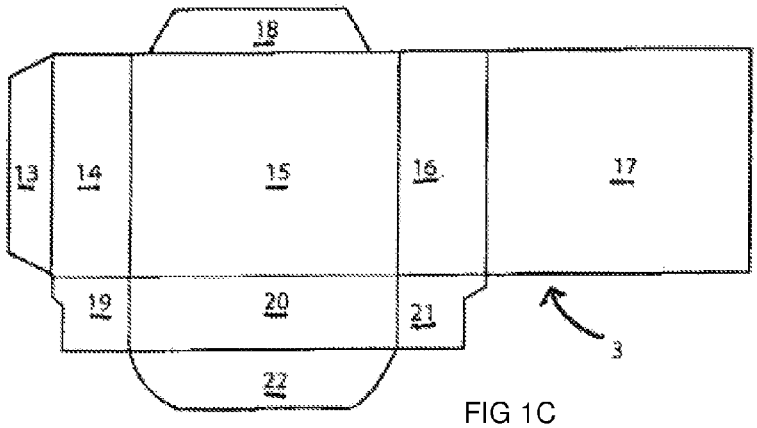
FIG 1C

FIG 4
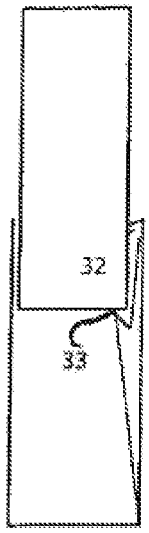
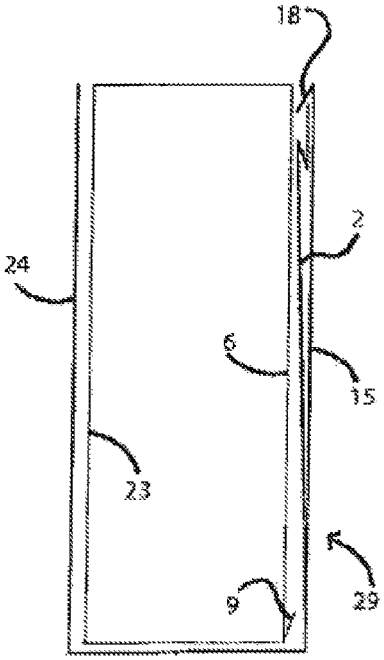
FIG 5A
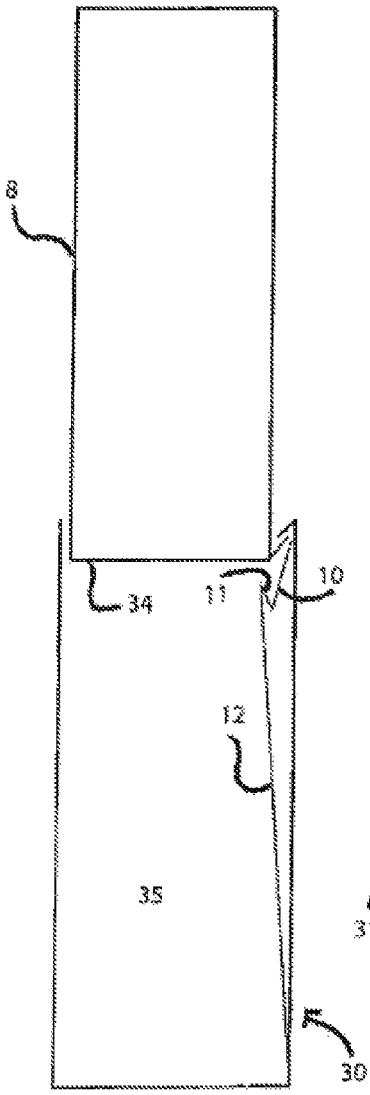
FIG 5B
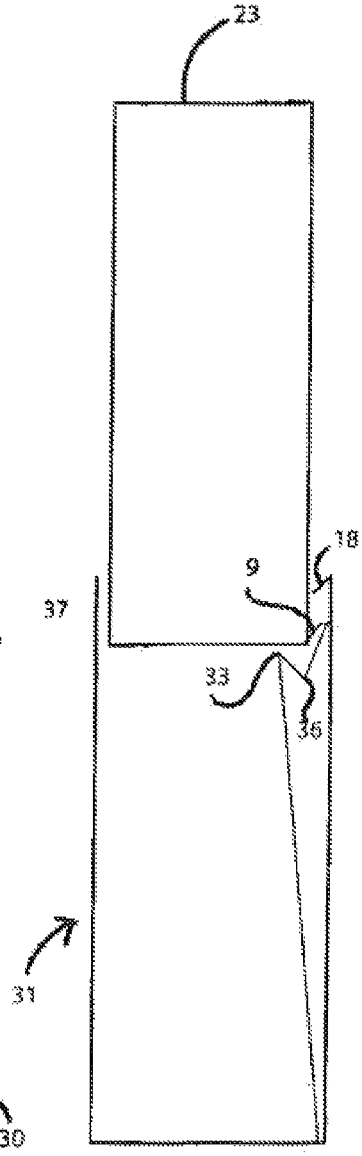
FIG 5C

40

41

42

FIG 15
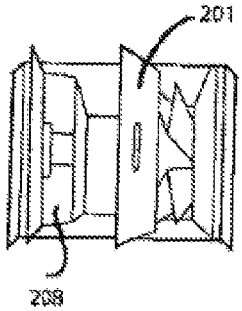
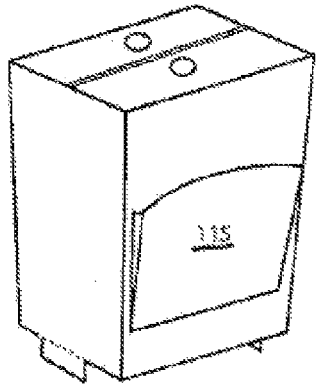
FIG 17
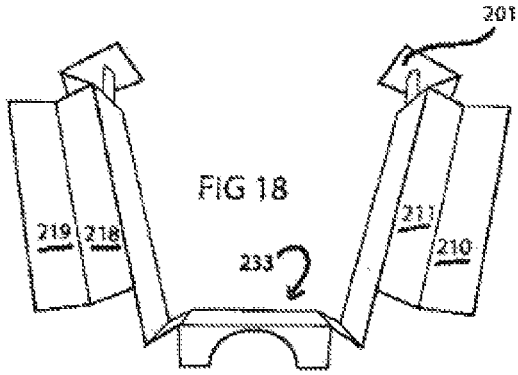
FIG 18
FIG 16
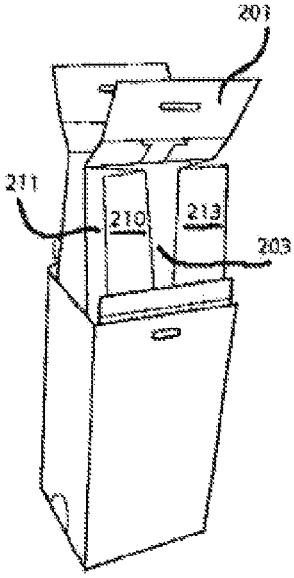
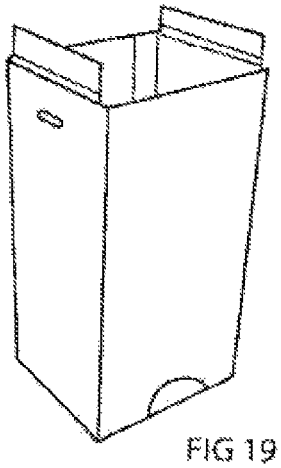
FIG 19
FIG 20
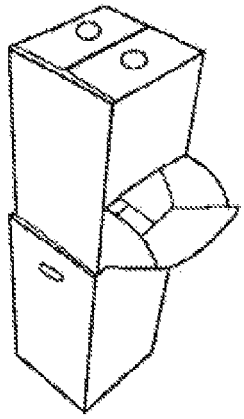

FIG 21
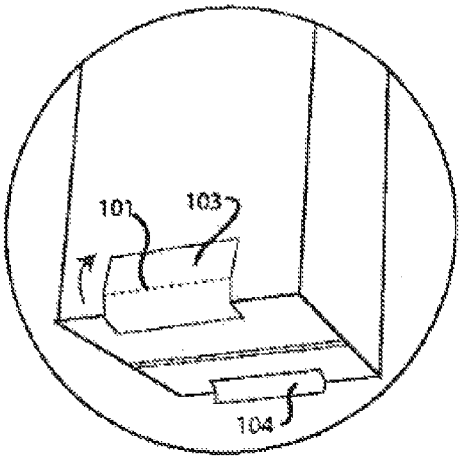
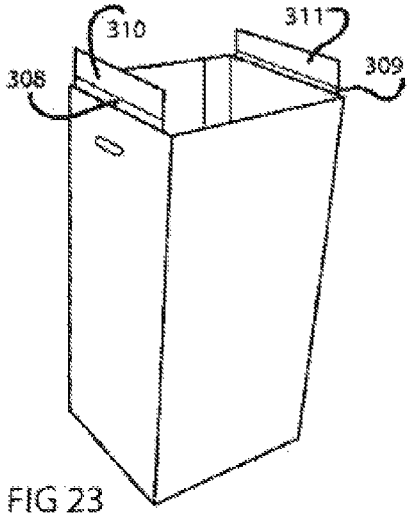
FIG 23
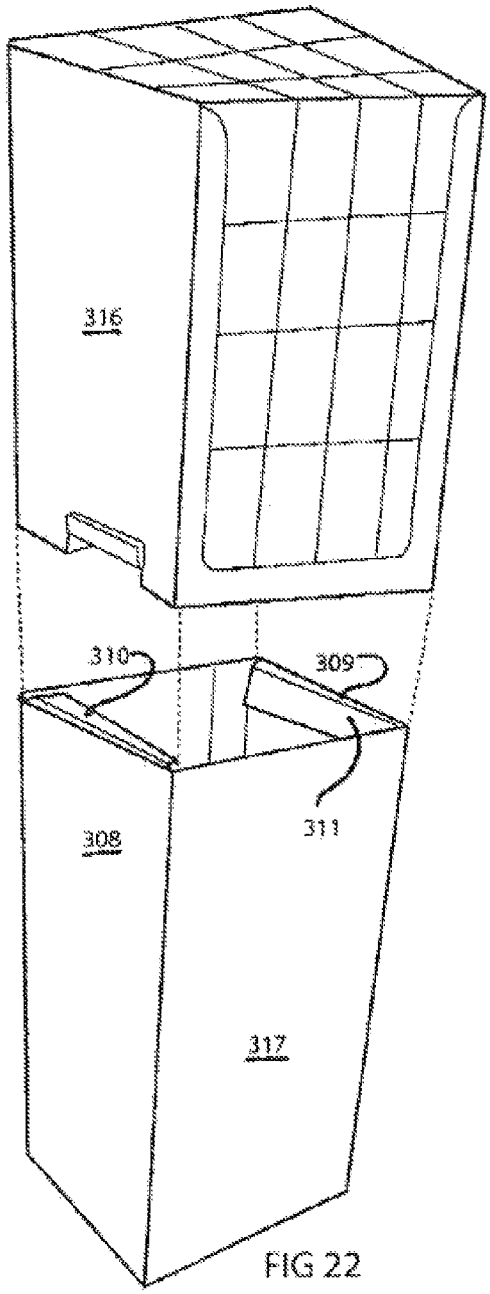
FIG 22

100
115
113
114
229
300

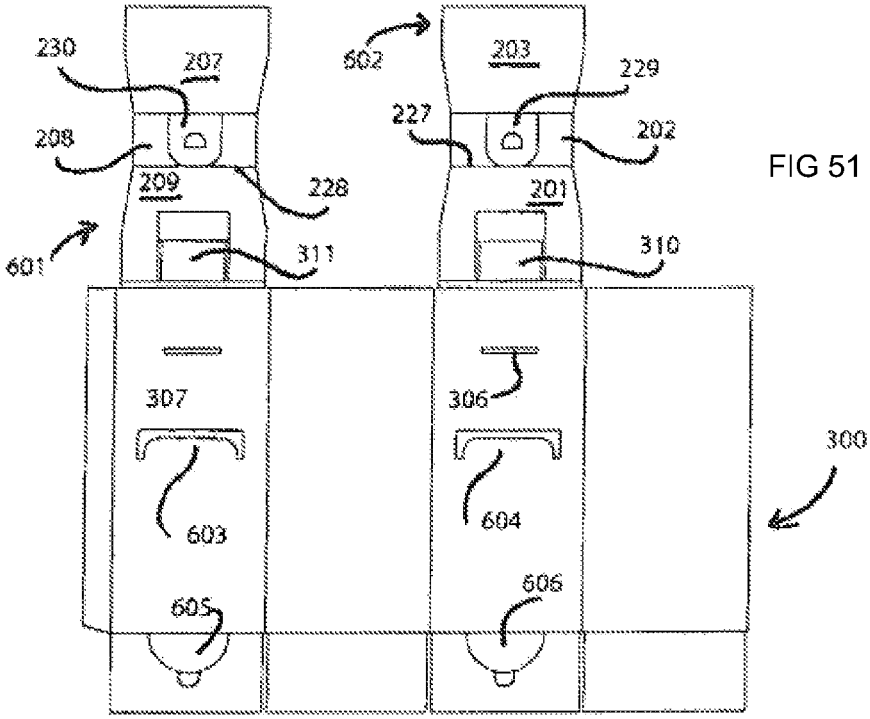
FIG 51
FIG 52
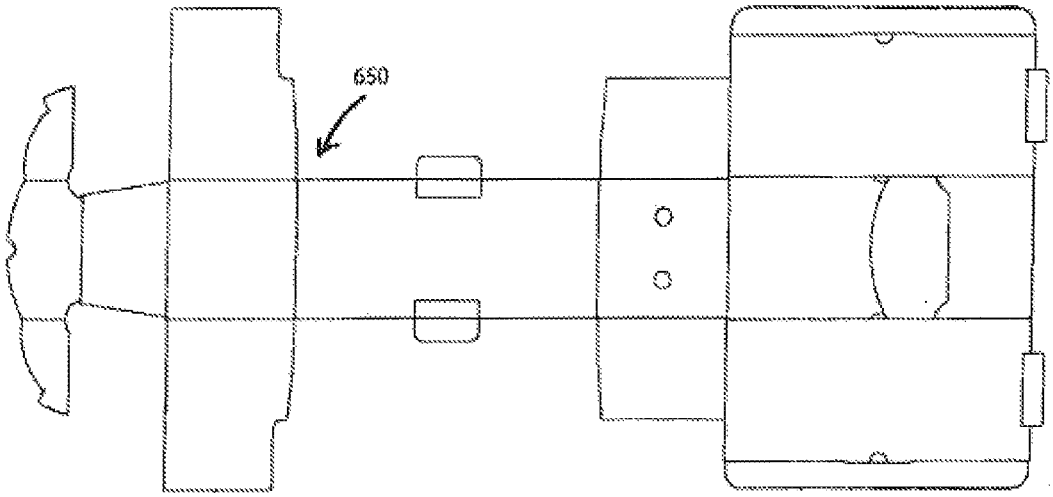

FIG 53A
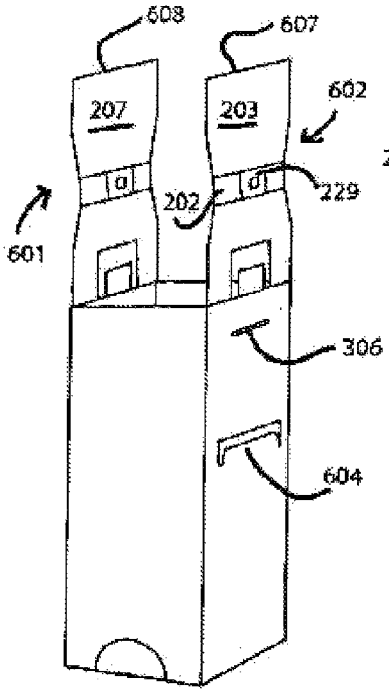
FIG 53B
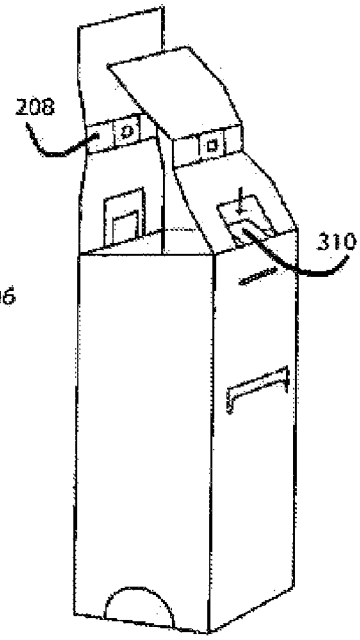
FIG 53C
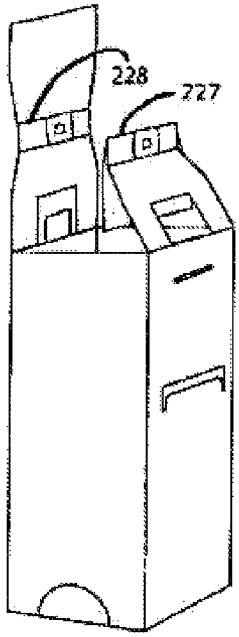
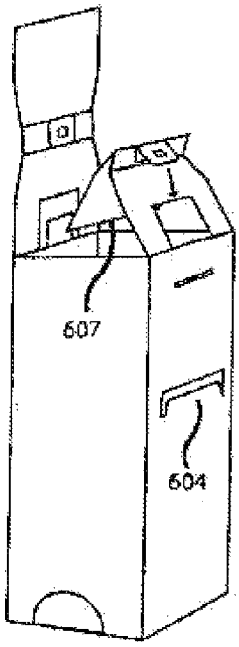
FIG 53D
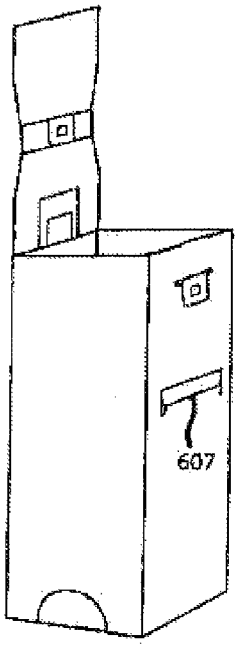
FIG 53E
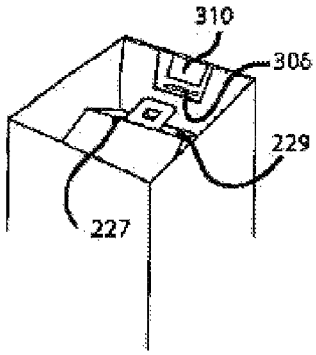
FIG 53F FIG 61A
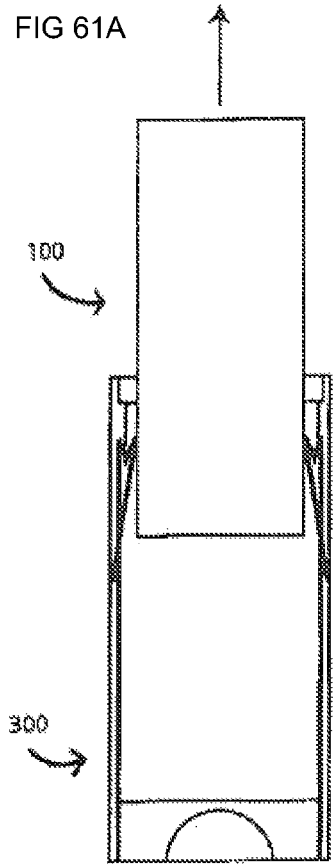
FIG 61B
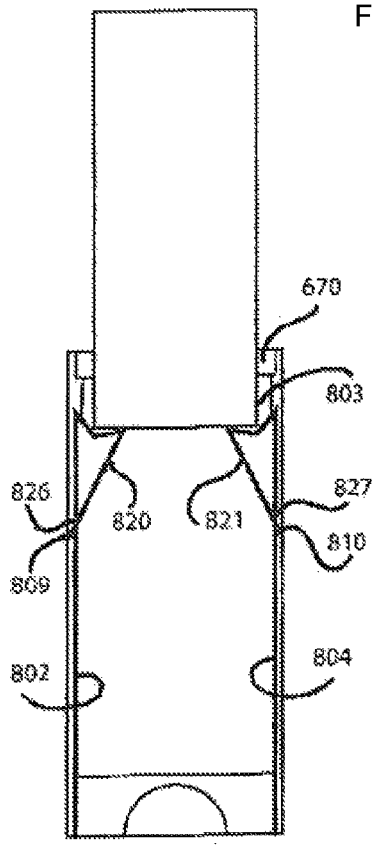
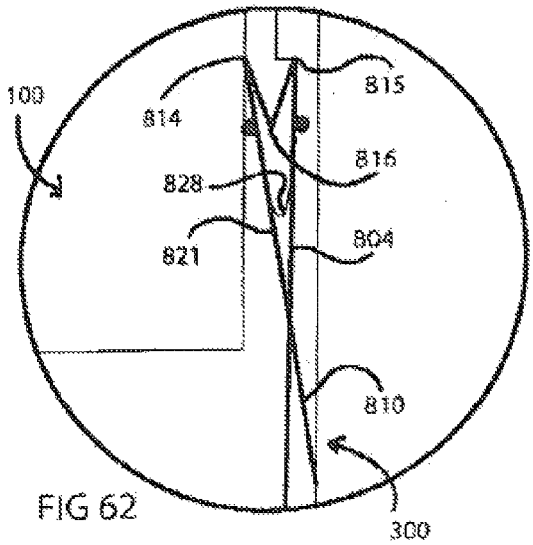
FIG 62
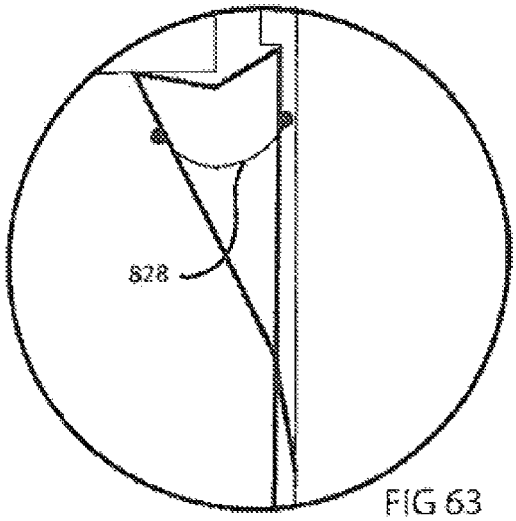
FIG 63

SLIDE AND LOCK DISPLAY SYSTEM

CROSS-REFERENCE TO RELATED APPLICATIONS

This application claims a priority benefit from a provisional patent filing, U.S. Application No. 60/875,225, filed on Dec. 16, 2006 in the United States Patent and Trademark Office, and titled "Slide and Lock Display System".

STATEMENT REGARDING FEDERALLY SPONSORED RESEARCH OR DEVELOPMENT

Not Applicable.

FIELD OF THE INVENTION

The point-of-purchase industry continuously struggles with creating displays that serve the needs of the manufacturers as well as the needs of the retailers.

It is well known that most displays require set up, and many displays to a varying degree take more time to set up than what the retailers and/or the manufacturers would like. Set up time means money to them. Further, displays that take too long to set up may be improperly set up, or may be perceived as too difficult to set up and may never see the light of day.

Although decisions to spend millions on displays are made at high levels, the set up of a display is made by low-level store associates. If the display is not set up, or the product is removed from the display and placed on the shelf for presentation, the money spent on that display is wasted.

News America Marketing, one of America's largest merchandising companies offers manufacturers a display building service where 4000 of their merchandisers out of 26 offices will visit stores under contract to ensure their clients displays get properly set up. In their sales pitch they claim that nationally only about 50% of all displays that ship to a store ever get set up. Their merchandising services group ensures a significantly greater success rate of deployment. Of course this service does not come cheap. Floor displays may cost between $5 and $40 to produce, and a merchandiser's visits may cost upwards of $20 per visit to set up a display. When the scale is thousands of stores, and millions of displays, ensuring compliance by using an outside service can get very expensive.

For the purposes of this application the inventor would like to focus attention on a very specific style of floor display. One made up of a separate Product Tray and a separate Display Base. During shipping and storage the Product Tray will often, but not always, travel inside the Display Base, referred as the "closed" position, and once in-store the Product Tray will sit on top of the Display Base, referred as the "open" position.

It is important to note, that although the focus of the application will be floor displays used in a retail environment it is the intent of the inventor that the invention described in this application has many other useful applications where this structure is not limited by size. Uses may include storage boxes, dispensers for candy, food and beverage, toys, pop-up greeting cards as well as a multitude of items where moving from a closed to open position quickly and easily is desirable. It is also important to note, that the invention may operate in a manual, semi-automatic, or fully automatic mode.

Millions of displays are shipped each year in a closed position, requiring store personnel to take time from other important store activities to set up a display. With more and more pressure on their time, retailers are insisting that marketers create pre-packed displays that are easy to set up, or as in many cases, they will require that the displays are shipped ready-to-sell, requiring no set up. Shipping a display that requires no set up is devastating to marketers, as this means that the display must travel in a fully assembled or open position, in its most inefficient shipping configuration. This also means that the display will need additional parts to ensure that it arrives intact, and most importantly it means that the displays will cost significantly more to make and ship, as displays that ship in the open position are much larger than ones that ship in the closed position. Less displays per pallet means it will require more trucks to deliver the same number of displays. More trucks means more gas, and more CO.sup.2 emissions released into our environment means a greater negative impact on our already stressed natural resources.

Wal-Mart, the world's largest retailer has announced that it is embracing a-massive effort to reduce the size of packaging and displays so that products are shipped more densely and more efficiently to the stores requiring less trucks, which in turn will require less fuel, resulting in less emissions and less pollutants into our environment.

It is to everyone's advantage to produce temporary, semi-permanent, and permanent display structures that ship in closed positions and can easily and quickly move to the open position. Further, it is desired that these displays are easy to manufacture, to pack out, to store and to ship.

BACKGROUND OF THE INVENTION

One of the ways that marketers have learned to address the problem is by sticking to display constructions that are well known in the industry. Familiarity by the end user with the display configuration goes a long way to ensure that a display is set up. One traditional floor display structure is compromised of a Product Tray that displays the product with a separate folded and/or collapsed Display Base. Once this display arrives, the retail associate lifts out the Product Tray, places it on the floor while the Display Base is folded into a structure that will hold the Product Tray, then the Product Tray is lifted and placed on the assembled base ready for customer presentation.

Marins, a French company markets a folding display, called the LAMA. It takes seconds to deploy and uses a rubber band mechanism to self construct. LAMA displays are now sold in more than 90 countries worldwide. This display does not come cheap, and is of limited use for those marketers seeking displays that hold product. It is more of a visual display than a shipper or product display. The base construction can hold a limited amount of weight without having to add a significant amount of parts which significantly increase the cost of the display and require much more time to assemble in-store. Also relying on rubber bands is an unpredictable proposition, since they may break, and/or lose their elasticity over time.

Another floor display structure includes a product tray that ships inside its base. First, the store associate pulls the product tray out of its base and places the product tray on the floor. Next, the base is turned upside down and the product tray is carefully lifted placed on top of the upside down base. Although this structure seems simple, there are some drawbacks. First, because the product tray and the base are separate pieces the base can easily be misplaced leaving their product tray without a base to sit on. Further, even if the display is set up and because the product tray simply sits on the base, and is not locked in any way, it can easily be "bumped" where the product tray and the base are left out of alignment creating an awkward look or in the case of heavy products, a dangerous situation, prone to spillage. It is also possible that the product tray will be removed from the base, as store personnel are constantly moving around displays to better serve their customers.

To minimize the problems described above there is a similar well known construction that has a base that is not turned upside down to hold the product tray, but rather includes a set of die-cut "push-in" tabs on each of the four corners of the base. When these tabs are pushed in they form a mini ledge that is designed to hold the product tray inside of its base, preventing the product tray from sliding down or sliding off the base if it is bumped. This structure still requires the product tray to be pulled out of the base and placed on the floor, while the "push-in" tabs on all four sides of the base are activated to create the mini ledge for the product tray. To complete the display the store associate lifts the product tray and carefully positions it to fit inside the base so that it can sit on top of the push-in tabs. Although this does not sound like a lot of work, many that use this structure will say that as easy as it sounds these displays are not always set up, or are improperly set up. The product tray and the shipper are still separate items so the same problems exist, that during the life of the display, the product tray may be separated from the base. Another drawback to this structure is that the full weight of the product tray is placed on the "push-in" tabs. Since the "push-in" tabs are cut from the base, they will not be able to accommodate heavy loads. Also, if the product tray is large or heavy, a single store associate may not be able to place the product tray on the base by themselves and may require additional help, tying up other store associates. Another version of this display, has a separate crisscross insert that may be placed inside the base to help hold heavier products. Although better than push tabs, it still requires significant set-up effort.

The Autoshelf is an automatic display system that slips out of its shipping carton and unfolds open ready to use. This system also uses rubber bands to deploy the display, one of their advantages over LAMA display described earlier, is that the Autoshelf is designed to hold product. Although the Autoshelf holds products, a major disadvantage is that it also ships "flat" and separate from the product it is designed to hold. The store associate has to find the "flat" Autoshelf display and deploy it. Only then can the store associate begin stocking the Autoshelf display with product. Often, from the marketer perspective, this is asking too much of the store associate and a pre-pack shipper is preferred. Further, a store associate may receive the shipment, open the product carton and not ever be aware that there is a "flat" unfolded display to set up and may simply proceed putting the product on the shelf, without ever realizing that a separate shelf display even exists for the product. Once the Autoshelf display is set up, the store associate still needs to load the display, taking valuable time away from serving customers or other necessary store activities. Another problem with Autoshelf is that it ships in a separate container than the product it is designed to hold. This creates additional shipping costs. Yet another problem, same as in Marin's LAMA displays, the Autoshelf uses rubber bands which will lose elasticity over time and can break prior to or during deployment. Finally, the Autoshelf structure requires a certain assembler skill level as the placement of rubber bands is more elaborate and more expensive than displays that do not rely on rubber bands for deployment.

Many have tried to create automatic bases that set up when a product tray is lifted out of it. One such display uses a rubber band mechanism that makes two pieces of paperboard snap to an "X" shaped support when the product tray is lifted past the height of the "X" support. The same problems exist here, rubber bands may lose their elasticity, and/or fail to deploy.

BRIEF SUMMARY OF THE INVENTION

Against the foregoing background, it is the primary object of the present invention to provide a display having a closed position for efficient shipping and storage, and upon arrival at an end destination quickly and easily sets up to an open position for display.

It is yet another object of the invention that deployment from closed to open position takes only a few seconds.

It is yet still another object of the invention, to provide a display that is considered a one piece display requiring no assembly of parts, for easy portability and set-up.

It is also the object of the invention to create a display that after assembly ships as a single unit, where the product tray and the base are in an interlocked relationship, so that the product tray and the base can not be easily separated from each other.

It is another object of the invention to create a display that deploys from a "closed" position to an "open" position without the use of rubber bands.

It is yet still another object of the present invention, to provide a display that allows for the product trays to be assembled and filled with product, then stored inside the base so that the display ships fully loaded, and requires in store stocking. Also, this structure will allow the product tray to be stored separately from the base of the display, prior to final assembly and shipping, offering yet more flexibility in fulfillment options.

It is but another object of the present invention to provide a display that allows for separate shipment of the bases, and separate shipment of the product trays so that the bases, may be manufactured in a separate place than the product trays, creating many more fulfillment options for the manufacturer. For example the product trays may be densely packed and shipped from China, while the bases may be produced locally, and the final assembly of bases and product trays could also be done locally, saving money on shipping of bases over great distances, and keeping part of the manufacturing in local economies.

It is another object of the invention to provide a display with a substantially flat profile that can be stored and shipped efficiently, and easily assembled at a future date.

It is the object of the invention to create a unique internal locking shelf structure that allows the product tray to be pulled in an upwards motion until it reaches a "locked" position within the base of the display leaving the product tray fixed at a predetermined height, as it rests on the internal shelf.

It is but another object of the present invention to ensure that when the product tray arrives at the "locked" position within the base, it may not be pulled further out of or completely from the base nor can it be pushed back into the base unless the structure is deliberately "unlocked". Once "unlocked" the product tray may be easily lowered or slid back into the base for future deployment.

It is yet another object of the present invention to simplify the store associates experience in setting up the display. First the store associate places their foot inside a "foot slot" at the back of the closed display base and simultaneously lifts the product tray straight up until the "locked" position is reached. To the delight and surprise of both marketers and retailers, alike, the total time to deploy this display from "closed" to "open" position is five seconds or less.

Another object of the present invention is that the product tray structure may be formed into any tray style including but not limited to: dump bin; shelf style; hanging hook; or stacking product style.

It is yet another object of the present invention to create a display structure for use with heavy products. It is well known that major retailers recommended floor displays designed to be set up by a single store associate should not exceed forty pounds. When the product tray is 'heavy' (over forty lbs.), two people are required to lift the display, and the structure is modified to include two "foot slots", one on each of opposite sides of the display so that each person can use their foot to hold the display in place as they lift the product tray into the "locked" position. For single person deployment of a 'heavy' product tray, an alternate embodiment is the inclusion of a spring, lever or similar force reduction mechanism to reduce the force required to the forty pounds or less level.

It is yet another object of the present invention that the display can be made any reasonable shape or size preferred by marketers or allowed by retailers. The size or shape can vary from a small counter top unit to approximately a full shipping pallet display.

It is but another object of the present invention to create a display that can be made from multiple temporary, biodegradable, semi-permanent and or permanent materials. Although the preferred embodiment is to use paperboard for construction, the invention may also be fabricated from wood, plastic, metal, or other well-known permanent display materials.

It is but another object of the present invention to modify the materials used in the internal structure to best support and deploy the display depending upon on the weight of the product tray, and or the display's end use environmental climate. The internal support mechanism may be made from plastic to ensure that the internal mechanism springs into action during deployment even under extremely humid conditions.

It is another object of the invention to vary the locking mechanism, to suit the needs of the product tray. The key is that there is always a shelf structure that deploys when the product tray is lifted past a certain predetermined point, and if desired, a lock that prevents the product tray from being lifted out of its base.

It is but another object of the present invention to use the same structure for smaller products and displays such as countertop and shelf displays, as well as toys, greeting cards, expanding shelf trays and a myriad of other displays and products that could benefit from such a locking mechanism.

It is further the intent of the inventor to use this structure in products where a closed and an open position are desired. One such application would be a personal home Halloween candy dispenser that is sold in store in a closed position to save on shipping costs and storage space by the store, and when brought home is easily deployed to an open position ready to provide candy to eager trick-or-treaters.

Another home application would be a beverage dispenser that is purchased in a closed position again for the shipping efficiency and deployed at home to an open position ready to dispense the beverage of choice. Another feature of the invention within this and other similar applications is that the display base when deployed, or in the locked position is empty and can be fabricated with a deliberate flap or door opening so as to become a receptacle for empty beverage containers, a fringe benefit of the structure.

It is further the intent of the inventor to use alternative modified structures to hold the product tray in the locked position. Although the preferred embodiment requires separate folded structures deliberately placed inside the base, another solution would utilize a modified base combining the base and locking mechanism in one continuous piece of paperboard or other material.

BRIEF DESCRIPTION OF THE DRAWINGS

The foregoing and still other objects and advantages of the present invention will be more apparent from the detailed explanation of the preferred embodiments of the invention in connection with the accompanying drawings, wherein:

FIGS. 1A-1C are plan views of the inner sleeve, single ledge, and base, respectively, that forms the lift an lock structure.

FIG. 4 is a cutaway side view of the inner sleeve sitting on a lowered ledge inside the base.

FIGS. 5A-5C are cutaway side views of the inner sleeve as it moves from collapsed or closed to extended or open position.

FIG. 15 is a top perspective view of double ledge with foot bridge, collapsed inside of base.

FIG. 16 is a perspective view showing the folded double ledge partially inserted into base.

FIG. 17 is a perspective view of assembled inner sleeve of FIG. 11

FIG. 18 is a perspective view of partially assembled double ledge, with foot bridge of FIG. 12.

FIG. 19 is a perspective view of assembled base of FIG. 13.

FIG. 20 is a perspective view of the structures in FIGS. 10A-10C fully assembled and in open position.

FIG. 21 is a perspective view of the bottom of inner sleeve of FIG. 11 showing the catch tabs moving to folded UP position.

FIG. 22 is a perspective view of the inner sleeve ready to be inserted into base.

FIG. 23 is a perspective view of the base with tabs in UP position. Tabs will be folded to DOWN position prior to inserting of inner sleeve.

FIG. 28A shows the catch tab resting on top of the inwardly folded base catch tab. FIG. 28B shows the inner sleeve fully engaged inside the base, where the catch tab is not visible.

FIG. 51 is a plan drawing of the Base with a modified shelf structure where panels extend upwards from the base.

FIG. 52 is a plan drawing of a modified one piece tuck style Product Tray which does not require gluing.

FIGS. 53A-53F are perspective drawings of plan drawings in FIGS. 51 and 52 showing a sequence of steps required to form the modified shelf structure using the folded flaps that extend from the base.

FIGS. 61A-61B are cross section views of shelf insert 800 in a "closed" position and an "open" position, respectively.

FIG. 62 is a cross section view of a spring mechanism.

FIG. 63 is a cross section view of the spring mechanism in the expanded or "open" position.

DETAILED DESCRIPTION OF THE INVENTION

Figure 2:
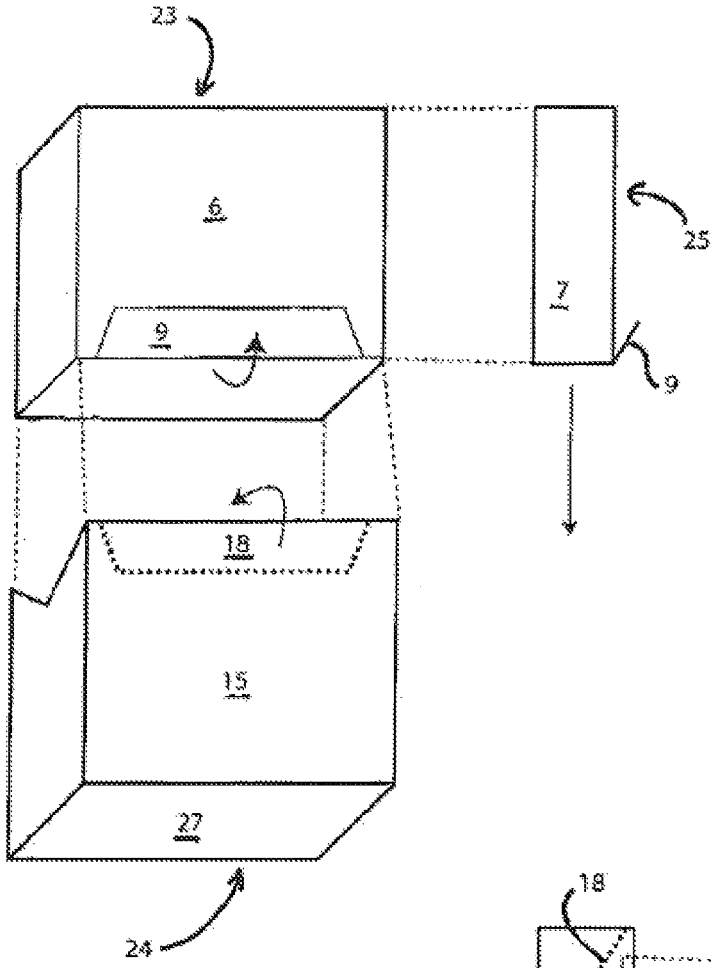
FIG. 2 is a perspective view of the base and inner sleeve, showing the folding direction of catch flaps, and how the inner sleeve relates to the base.
Figures 3A, 3B, 3C:
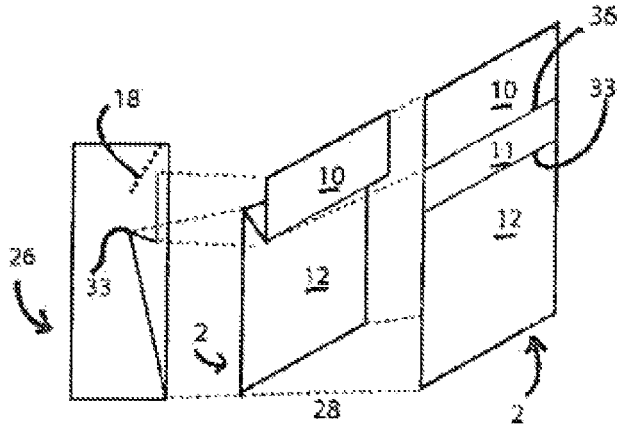
FIGS. 3A-3B are cutaway side views of the base and inner sleeve.
FIG. 3C is a perspective view of the ledge showing how it relates to the cutaway side view.

Referring to the drawings and, in particular to FIGS. 1A-1B, FIG. 2, and FIGS. 3A-3B thereof the display with a slide and lock structure of the present invention is provided and referred to generally by inner sleeve 1, base 3 and ledge 2. (Please note the terms 'product tray' and 'inner sleeve' are interchangeable, and similarly the terms 'base' and 'outer sleeve' are interchangeable as well.) The simple display structure may be made from paperboard, plastic, or any combination of substrates that would form a suitable inner sleeve and base to be used for display purposes.

It is further the intent of the inventor, to make the inner sleeve 23 and base 24 from other more durable materials for semi-permanent and permanent displays. This change in substrates may be desired for a more elegant look, or for a more durable structure. The materials for this alternate display structure may include but are not limited to plastic, wood metal, and other well known display and fixture materials.

In the preferred embodiment the slide and lock display would have an inner sleeve 23 with a single catch tab 9, a single base 24 with a single catch tab 18 and ledge 2 made from paperboard or plastic. Although the ledge made from foldable paperboard, such as corrugated board, is the preferred embodiment, in certain instances it may be preferred to use plastic or other suitable, foldable material that could be formed into a ledge. There also may be instances where a solid inner sleeve 23 and base 24 may be preferred such as injection molded plastic, as often in today's competitive retail environment more and more temporary displays are combining paper board and plastic to achieve highly stylized effects.

In the preferred embodiment the display base would have a bottom 27, either tuck flap 19, 20, 21, 22 or an auto bottom (not shown) or a bottom that is glued or taped. An auto bottom refers to a well known packaging closure that requires no tuck flaps, but is glued and folded in manufacturing so that it sets up without the need to tuck flaps in order to assemble the structure. However, the bottom is not necessary if a separate ledge structure is added by gluing it to interior of panel 17 (not shown) so that it would have the same height as panel 12 when it supports inner sleeve from sliding back into the base. Many of the new specialty gluers are able to add separate structures in position and in line without a separate operation and without slowing down the manufacturing speed.

Another way to add a ledge would be with specialty gluers that are now able to automatically glue separate tabs (ledge) to inner panels at high speeds. A less desirable but effective way to create the ledge is by creating a ledge by cutting and folding a tab from panel 17. This is less desirable because it would not automatically lock. Also the cut out left by folding the ledge tab makes the display look less desirable. The inventor acknowledges that although these alternate options would require less parts and would cost less to produce, that most available machinery is not suited to these tricky gluing options. The preferred embodiment would make the slide and lock display easy to manufacture by the broadest audience, that would mean that the ledge remain a separate part. The inventor further acknowledges that in high volume situations, it would be more desirable to make the display from only two parts rather than three parts, as assembly of two parts would take less time than the assembly of three parts. These are some of the considerations one must decide to determine which embodiment is preferred as different applications have different requirements.

Figures 50A, 50B, 50C, 50D, 50E:
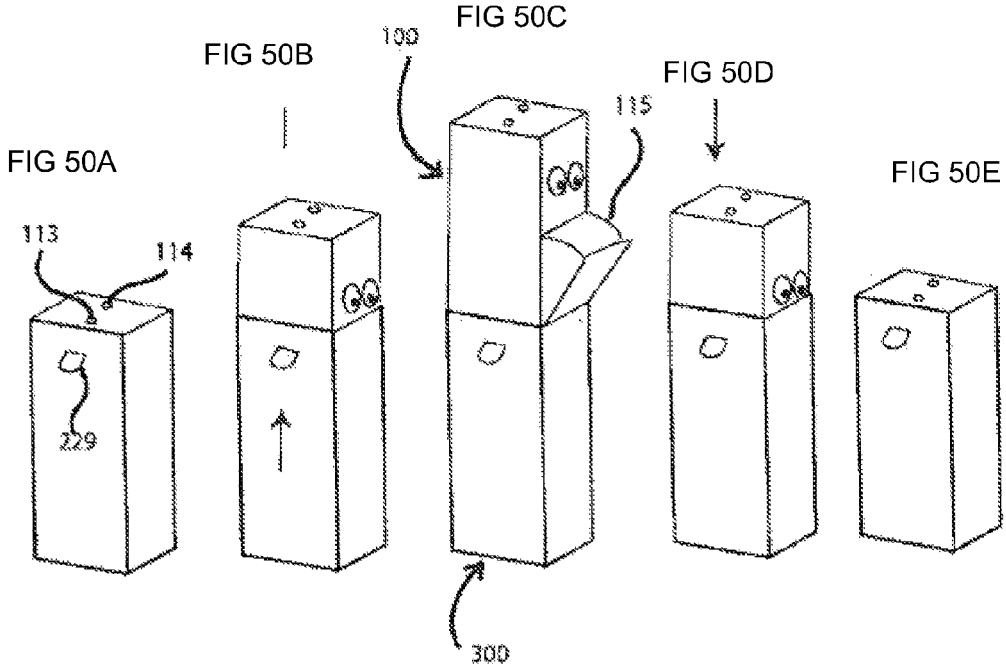
FIGS. 50A-50E are perspective views of the structure of FIGS. 28A-28B with showing that the structure may be extended to "open position", and then retracted to a "closed position".

In the preferred embodiment the ledge 2 is a flat structure that is made from flexible material that is folded on fold lines 33 & 36 to create a spring action created by the memory in the material being used. It is important to note that the material being used for the ledge must be suitable for the weight of the inner sleeve. For example if the display is a greeting card, or if there is little pressure from the base as in a slide and lock display that has a horizontal application such as a shelf tray FIG. 50 then the ledge may be made from lightweight material as the inner sleeve and base. If the use is to hold heavy material, then the ledge must be made from stronger, more suited material. If the display will be in a humid or wet environment, or will be in storage for long periods of time then a more resilient material needs to be used for the ledge.

FIGS. 5A-5C are cutaway side views that show how the slide and lock mechanism works. In the first illustration 29, FIG. 5A, inner sleeve 23, is collapsed inside the base 24, panels 10, 11 and 12 of ledge 2 are compressed between exterior of inner sleeve rear panel 6 and interior of rear base panel 15, as are catch tabs 9 and 18, panels 10, 11 and 12. The memory, created in the flexible material, from the compression puts the ledge into a spring-like state ready to expand once it has the space to do so. In illustration 30, FIG. 5B, bottom 34 of inner sleeve 23 travels past fold 11 allowing tab 18 to snap away from exterior of panel 6 and slide under tab 9 nesting between the rear of tab 9 and interior of panel 15 forming a lock and not allowing the sleeve to slide out of the base. As the inner sleeve 23 moves past fold 11, ledge 2 is pushed into an extended position into open cavity 35 by the memory stored from the compression of panels 10,11 and 12, forming a ledge 11 upon which bottom 34 of inner sleeve 23 can rest as shown in illustration 31, FIG. 5C, preventing it from sliding back into base 24. It is important that inner sleeve 23 and base 24 fit snug so that the contact between exterior of front panel 8 of inner sleeve 23 and interior of front panel 17 of base 24 is enough to keep the display from leaning forward or falling out. Depending on the use of the display it may be necessary to enlarge the amount of contact or overlap between these surfaces as shown in FIG. 4 at 32. It is also important that the fit on the opposite sides is also snug but not too tight as to obstruct the movement of the inner sleeve 23 inside base 24 as it moves from closed to open position. Also if the fit is too loose the locking mechanism will not properly engage.

Figure 6:
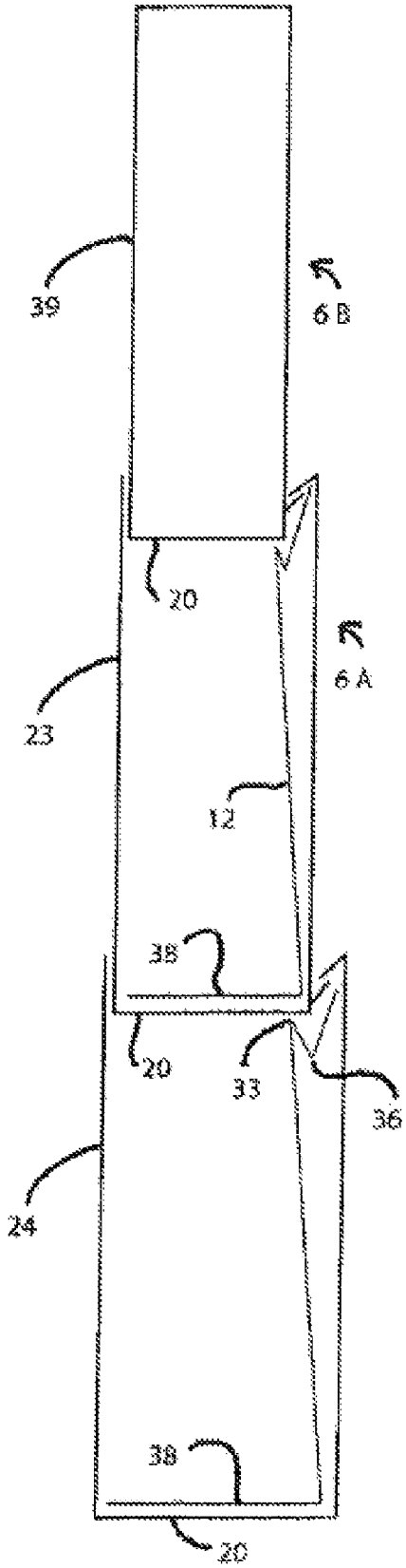
FIG. 6 is a cutaway side view of two inner sleeves fully extended showing a three tiered tower.

FIG. 6 is a cutaway side view showing how the slide and lock mechanism may be used to create taller structures, by adding a second inner sleeve 6B that locks into inner sleeve 6A or 23 making the display three tiers tall. It is also important to note that an additional optional panel 38 has been added to ledge panel 12. This panel will ensure that panel 12 remains at the intersection of bottom 20 and panel 6A of inner sleeve 23. Panel 38 was also added to base 24. It is important to note that if inner sleeves 23 and 39 do not have bottoms 20 then the lower edge of panel 6A or 6B would slide down and rest on fold 36.

Figures 7A, 7B, 7C:
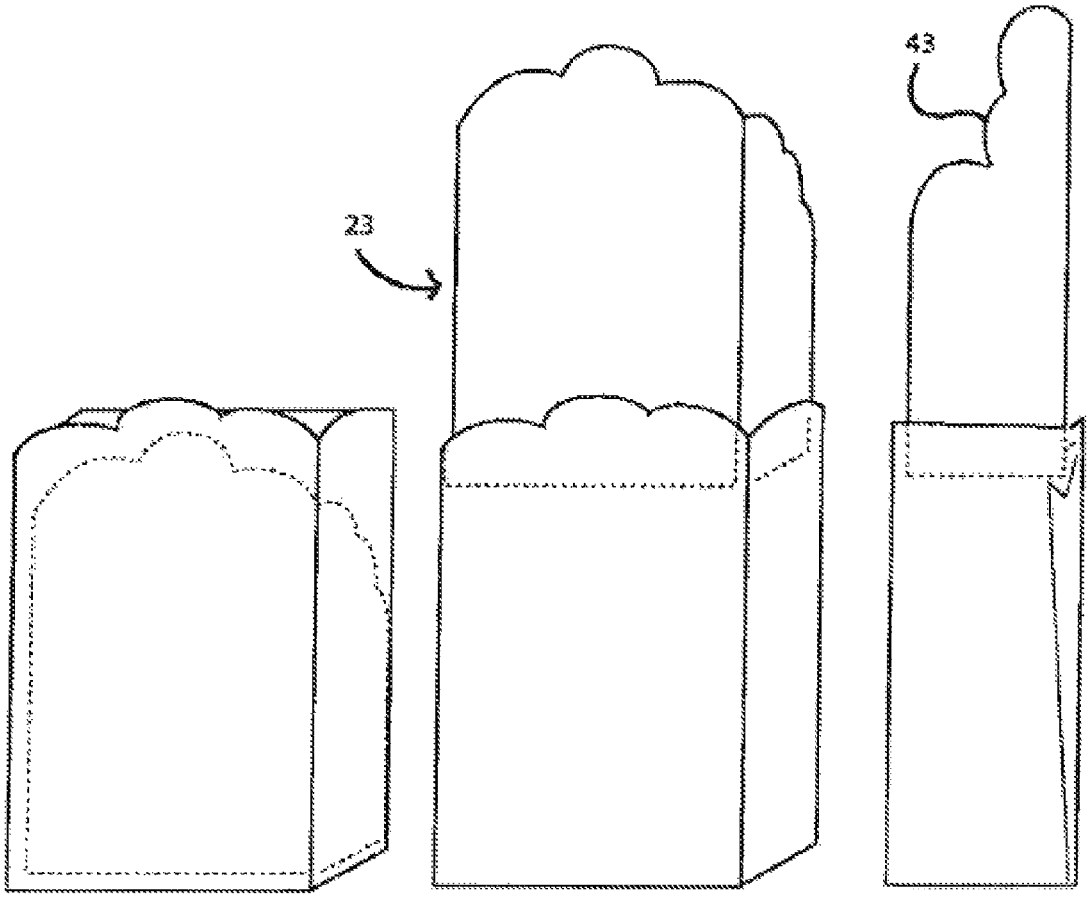
FIGS. 7A-7B are perspective views of an artistic version of the inner sleeve moving from closed to open position.
FIG. 7C is a cutaway side view of the same structure in the open position.

FIGS. 7A-7B show how this display structure has a closed position 40 (FIG. 7A) and open position 41 (FIG. 7B). The inner sleeve 23 may be custom die cut 43. FIG. 7C is a cutaway side view of the same structure. It is the intent of the inventor to use this structure as a retail display, where an opening in base 24 allows for the presentation of product 44

Figure 8:
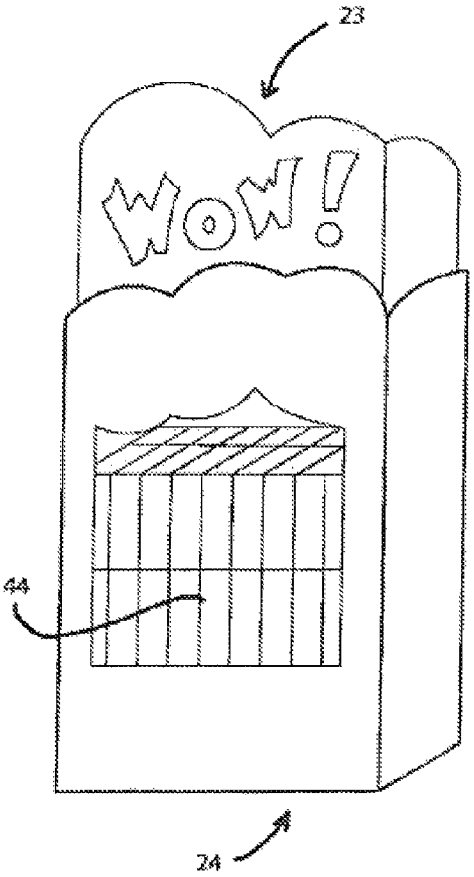
FIG. 8 is a perspective view of a display version in the open position where there is an opening in the base to showcase product as in a shopping environment. The inner sleeve serves as a billboard for advertising or informational messages.
Figure 9:
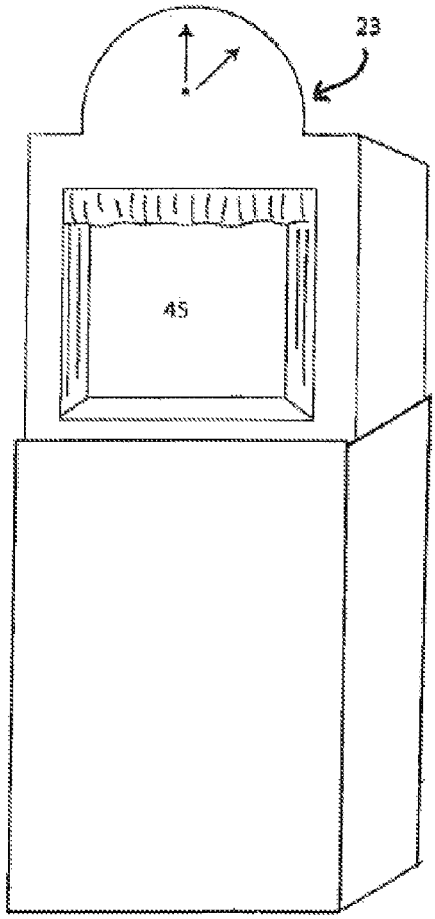
FIG. 9 is a perspective view of the structure with an opening in the inner sleeve showing how it may be used as a puppet theater. It is important to note that this may be a mini-tabletop or life-sized version.

(see FIG. 8), and inner sleeve 23 serves as a display header. It is also the intent of the inventor to use the structure as a toy. FIG. 9 is an example of a puppet theater where the inner sleeve 23 has a window cut out to serve as a stage.

Figure 10A:
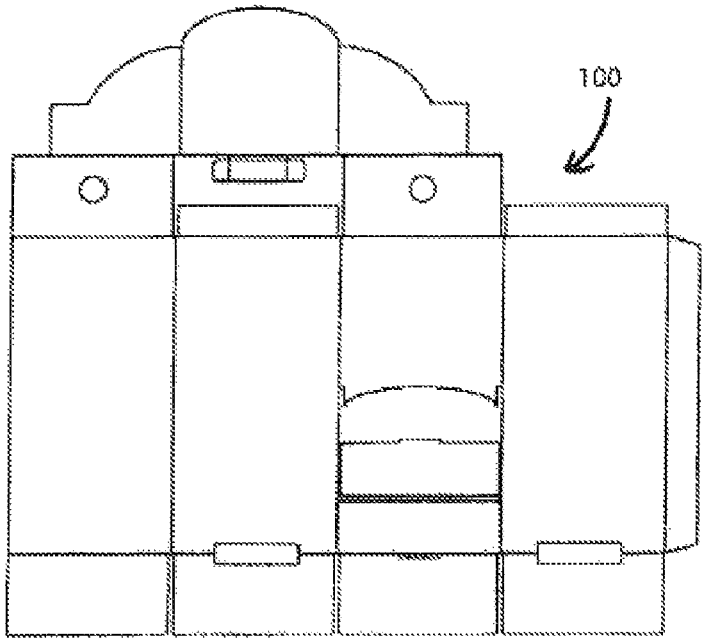
FIGS. 10A-10C are plan views of the inner sleeve, double ledge with foot bridge, and base, respectively.
Figure 10B:
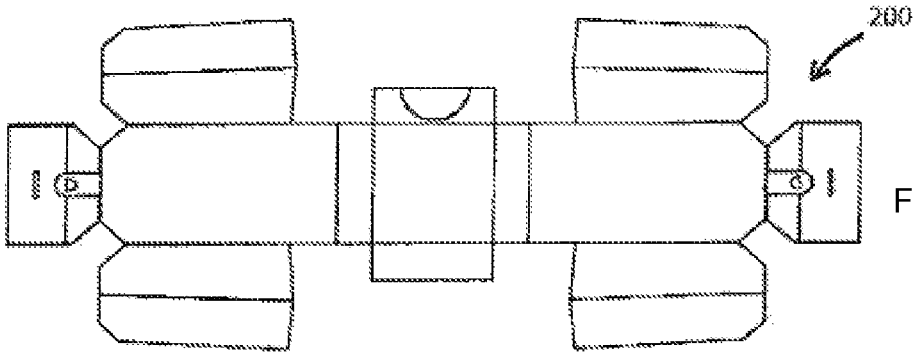
Figure 10C:
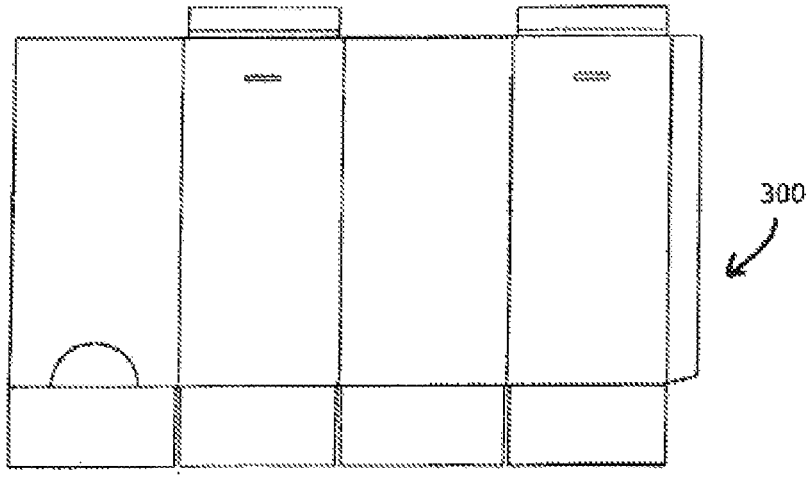

In addition to the preferred embodiment described above, the slide and lock display structure has many useful applications as a weight bearing display. FIGS. 10A-10C feature one such structure consisting of three parts an inner sleeve 100 (FIG. 10A), a double ledge with foot-bridge 200 (FIG. 10B), and a base 300 (FIG. 10C).

Figure 12:
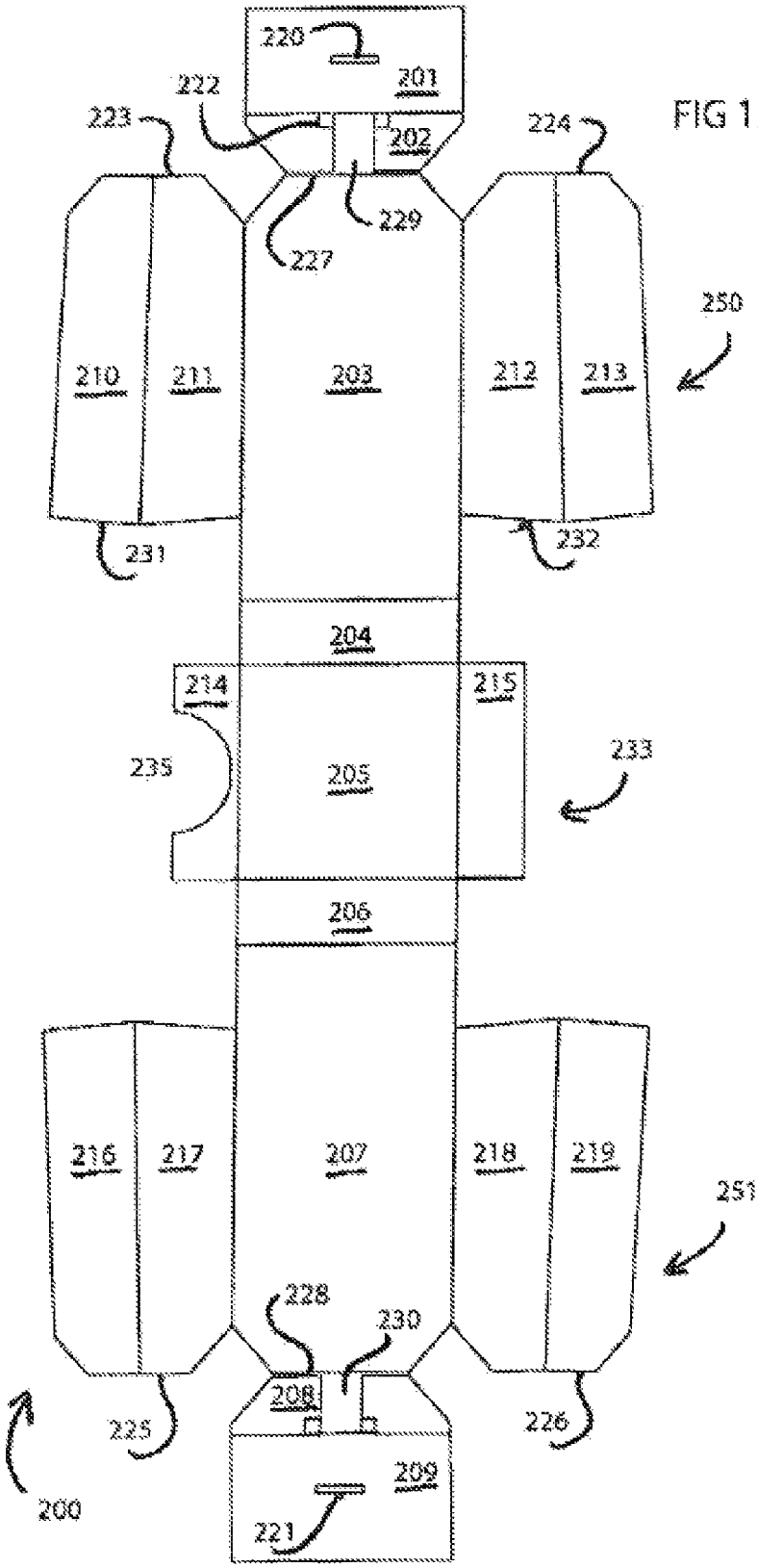
FIG. 12 is a plan view of ledge with special panel cuts allowing for easier insertion of the inner sleeve into the base.
Figure 13:
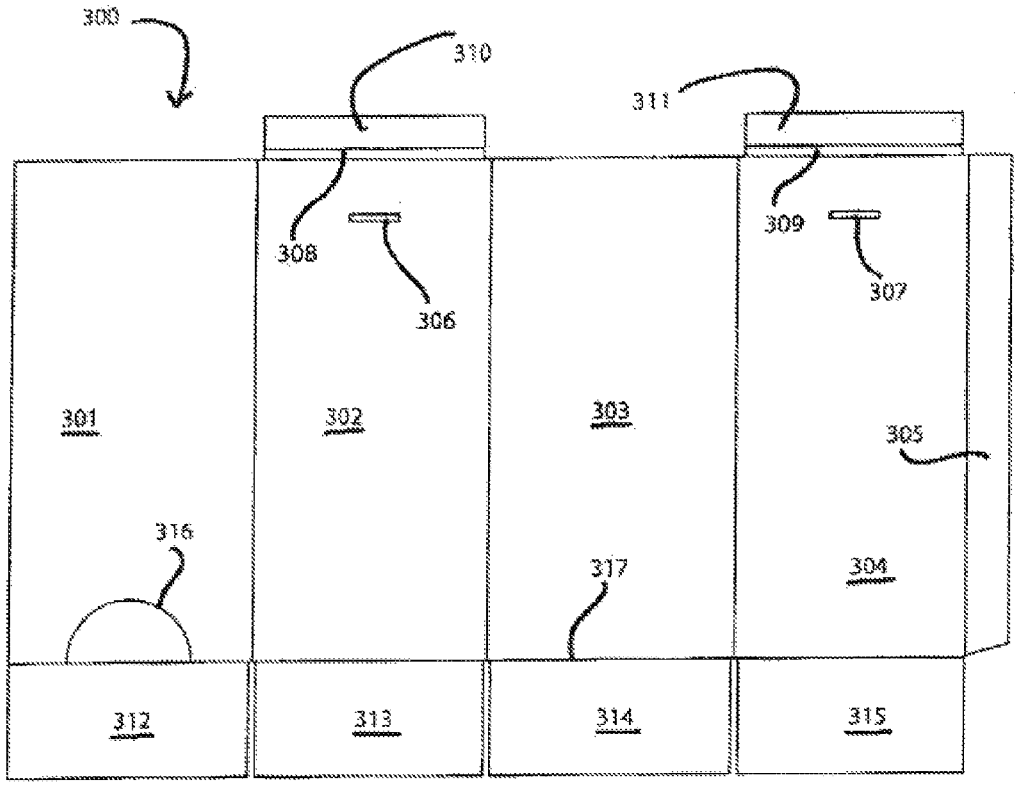
FIG. 13 is a plan view of base of FIG. 10C with foot bridge entrance.
Figure 14:
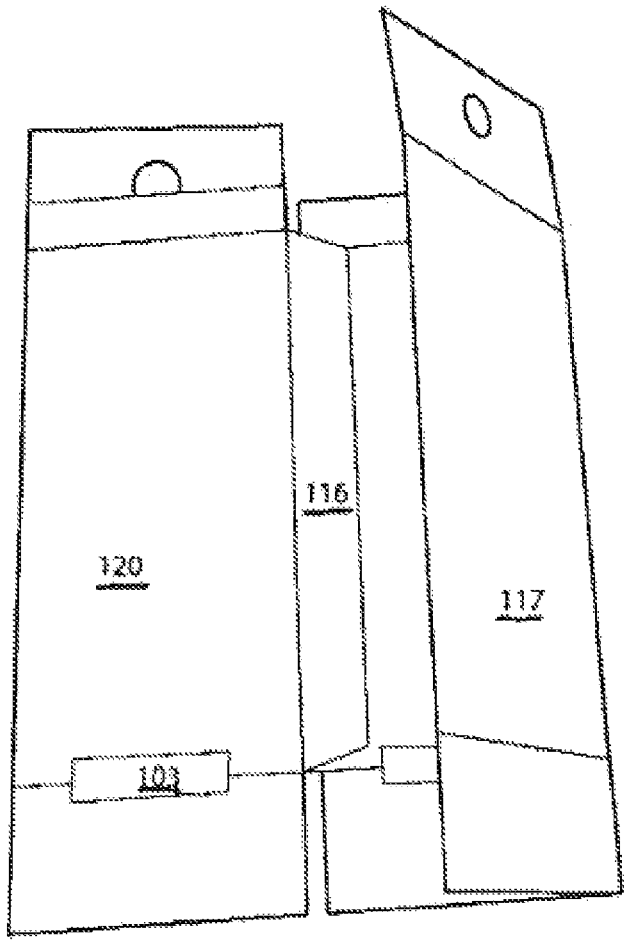
FIG. 14 is a perspective view of FIG. 11 showing panel folding with visible glue flap.
Figure 40:
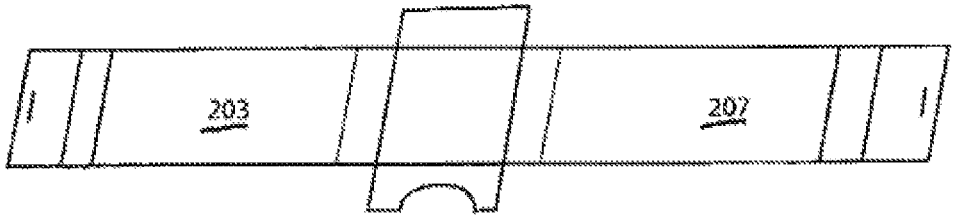
FIG. 40 is a perspective plan view of the double ledge with foot bridge, where the double ledge has no reinforcing spring panels.
Figure 41:
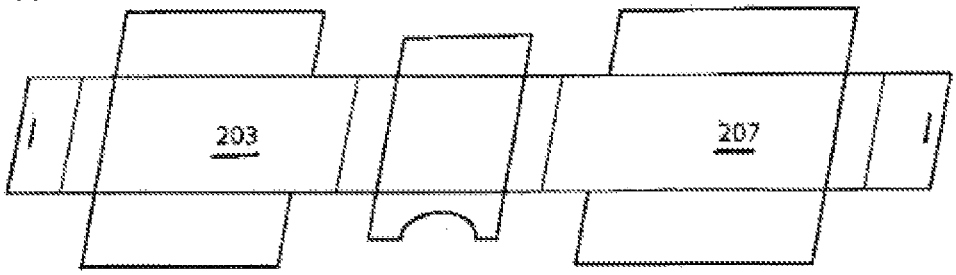
FIG. 41 is a perspective plan view of the double ledge with foot bridge, where the double ledge has four (two per ledge) reinforcing spring panels.
Figure 42:
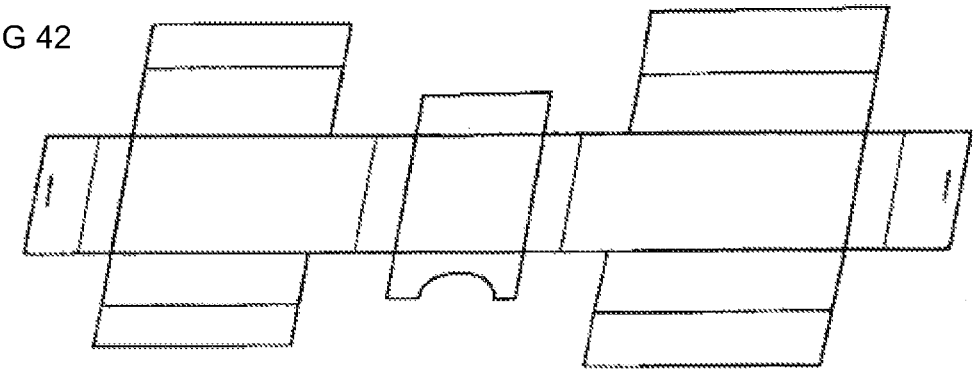
FIG. 42 is a perspective plan view of the double ledge with foot bridge, where the double ledge has eight (four per ledge) reinforcing spring panels.

FIG. 12 introduces a double ledge with a foot-bridge 233 with foot entrance 235. FIG. 14 shows the assembly of the inner sleeve 100. Panel 117 folds over and glues to glue tab 116. FIG. 17 shows the inner sleeve 100 is fully assembled. FIG. 18 shows the partial assembly of the double ledge with foot-bridge 233, and FIG. 19 shows base 300 of FIG. 13 to complete the slide and lock display. It is the intent of the inventor to vary the style, material and construction of the double ledge panel 200 to adequately support the product weight placed in inner sleeve 100. For examples as the weight in inner sleeve 100 increases, reinforcing panels 212, 213, 210, 211, 216, 217, 218 and 219 may be added to panels 203 and 207, as shown in FIG. 40, FIG. 41 and FIG. 42, to create more weight bearing strength. Adding those panels will also create more spring tension in deployment of the double ledge.

FIG. 16 shows a perspective view of an assembled double ledge of FIG. 18 being inserted into base 300. Note reinforcing panels 212, 213, 210, 211, 216, 217, 218 and 219 are placed in an accordion fashion so as to create maximum tension and spring. FIG. 20 is perspective view of inner sleeve 100 of, double ledge 200 and base 300 of FIG. 10 fully assembled.

Figure 11:
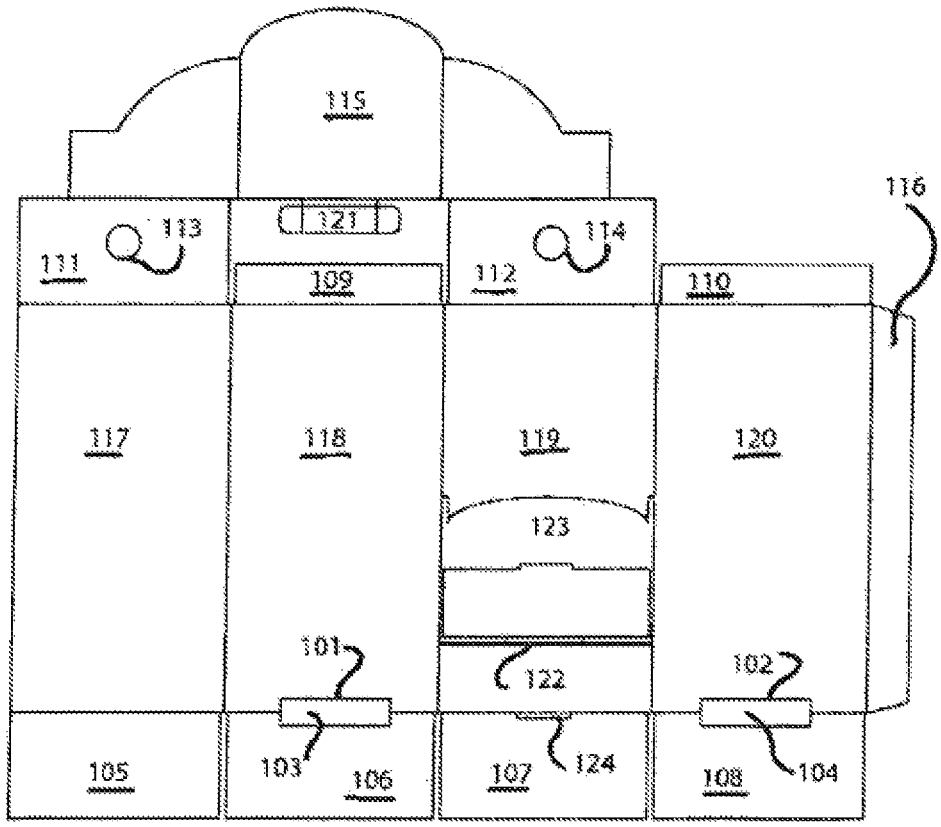
FIG. 11 is a plan view of inner sleeve of FIG. 10A.

FIG. 21 shows the inner sleeve catch tabs 103 and 104 moving from its original DOWN position to its loaded UP position. This is done by folding catch tab 104 on score 102 and catch tab 103 on score 101, and sliding the inner sleeve inside the base. The inner sleeve 316 shown in FIG. 22 works the same as inner sleeve 100 except it is designed to hold stackable product. The catch tabs 103 and 104 are kept in the UP position because the space between the interior base panel's 302 and 304 of FIG. 13 and the exterior inner sleeve panel's 118 and 120 of FIG. 11 is deliberately too narrow to allow for the free movement of the catch tabs to naturally move to the DOWN position, while at rest or while in motion when the inner sleeve is pulled up from the base.

Figure 24A:
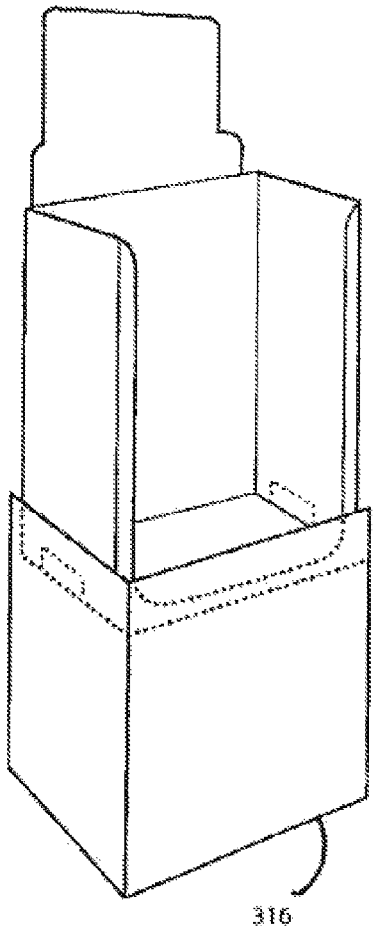
FIG. 24A is a perspective view of the inner sleeve resting on the double ledge inside the base.
Figure 24B:
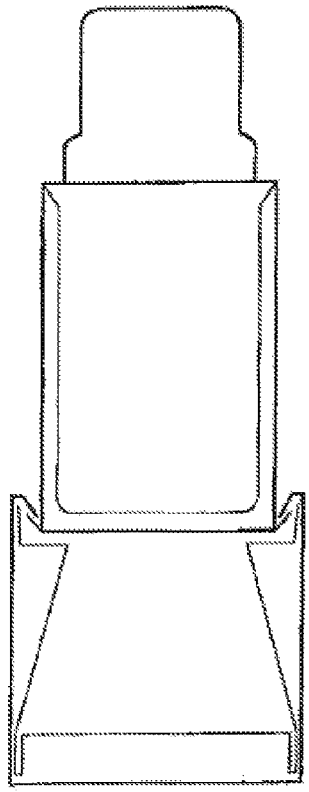
FIG. 24B is a front cutaway view of the same.
Figure 25:
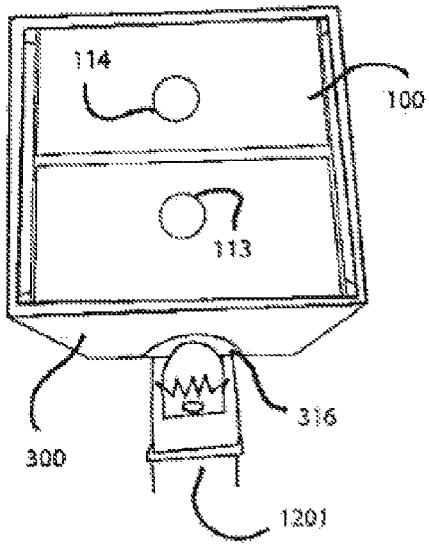
FIG. 25 is a perspective top view of the inner sleeve inside the base, with a foot inserted into the foot bridge at the bottom of the base.
Figure 26:
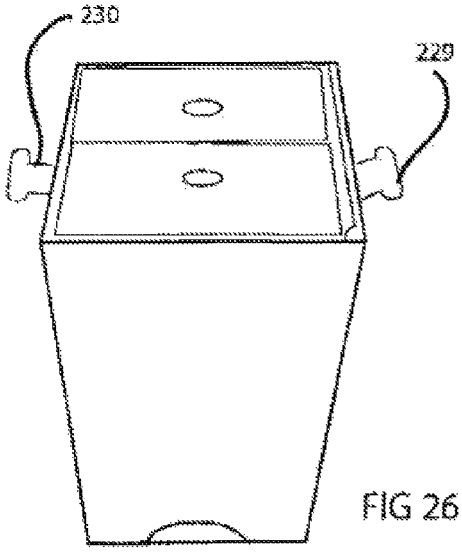
FIG. 26 is a perspective top view of the inner sleeve inside the base, with the right and left double ledge pull tabs showing.
Figure 27:
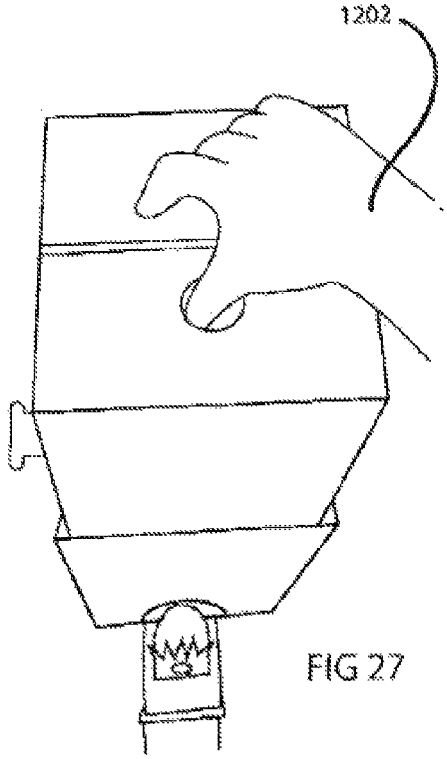
FIG. 27 is a perspective top view of the inner sleeve being pulled out of the base, while a foot inserted into the foot bridge at the bottom of the base.

FIG. 24A shows a perspective view the inner sleeve of FIG. 22 sitting inside base 316 which is shorter than the inner sleeve. FIG. 24B is a front cutaway view of the same structure. It is the intent of the inventor to allow the inner sleeve to be taller than the base to achieve taller structures if desired. FIG. 25 shows a foot 1201 being inserted into the foot-bridge 316 of base 300 as shown in FIG. 13. The inner sleeve is collapsed inside of base ready for deployment. FIG. 26 shows pull tabs 229 and 230. These tabs are necessary if the display needs to be retractable, if the display will deployed only once, these tabs may be removed after the inner sleeve is collapsed inside the base. FIG. 27 shows the relationship between the foot 1201 and the hand 1202 when the slide and lock display as it is being deployed. The foot is placed inside the foot-bridge 316 to prevent the base from being raised as the inner sleeve is being pulled UP by the hand 1202 from the base. Because of the tight fit between the inner sleeve and the base, if the foot 1201 was not placed inside the foot-bridge while raising the inner sleeve, the base would also be raised. It is worth noting that it is the intent of the inventor, to use this structure in applications other than floor displays. Where instead of using a foot to keep the base from traveling with the inner sleeve when it is being pulled, that other means may also be used, including foot tabs you step on, openings or just the placement of a hand in instances where the structures are small enough. Finger openings 113 and 114 of FIG. 11 may be replaced by other well known handles formed either from the panels of the inner sleeve, or separately attached to the inner sleeve, by glue, tabs, rivets or other well known means of attachment.

Figure 28A:
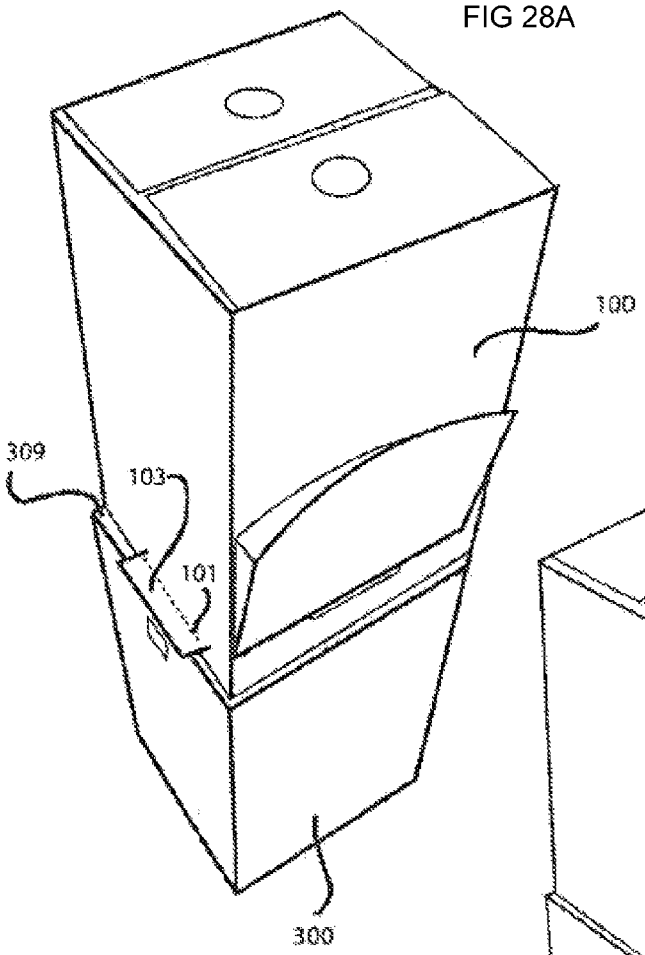
FIGS. 28A-28B are perspective views of the inner sleeve being placed inside the base.
Figure 28B:
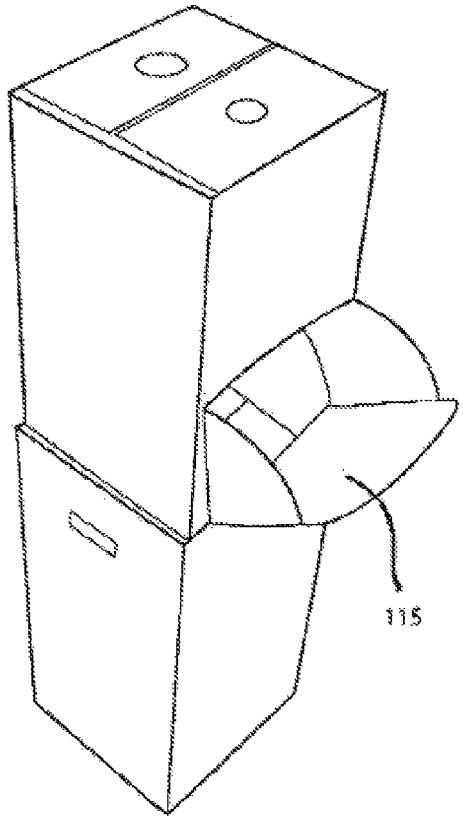

FIGS. 28A-28B show a perspective views of inner sleeve 100 in relationship to base 300. FIG. 28A shows the inner sleeve 100 sitting on top base 300 just before the inner sleeve is pushed in side the base for shipping or storage. Note that catch tab 103 of FIG. 21 is resting on top of fold 309, as catch tab 104 on the opposite side is sitting on fold 308 (not shown). As the inner sleeve is pushed downwards into the base, catch tabs 103 and 104 will fold upwards on folds 101 and 102 respectfully, in effect preparing the structure to perform the slide and lock mechanism. FIG. 28B shows the inner sleeve 100 resting inside of base 300. In this position, the inner sleeve 100 is resting on top of the expanded ledge 200 with catch tabs 103 and 104 facing in the UP position where the interior of catch tab 103 is in direct contact with the exterior of panel 310, and the interior of catch tab 104 is in direct contact with the exterior of catch panel 311 (not shown).

Figure 30:
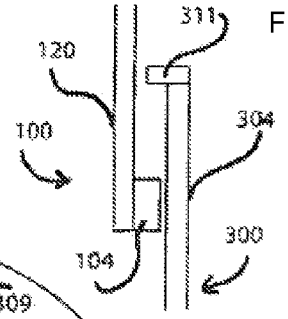
FIG. 30 is a cutaway side view of a further embodiment of a stop mechanism.
Figure 29:
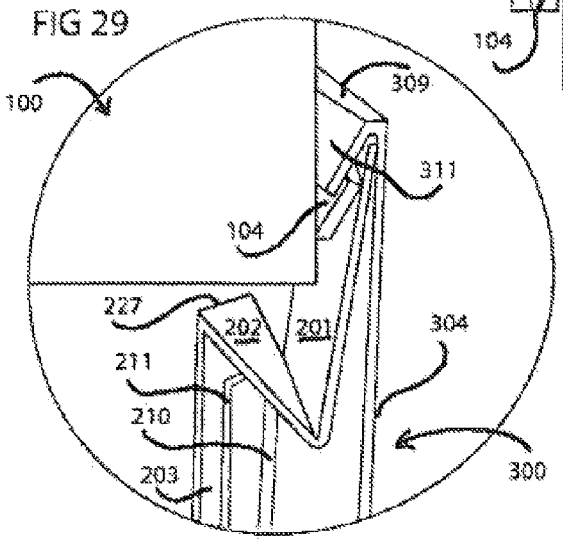
FIG. 29 is a perspective cutaway front view of the fully engaged locking mechanism comprised of the catch tab of the inner sleeve, the catch tab of the base and the ledge.
Figure 31:
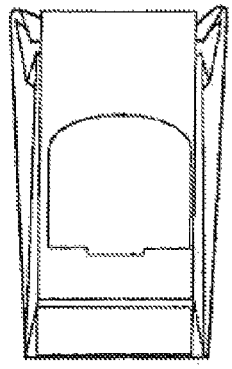
FIG. 31 is a perspective cutaway front view of the inner sleeve fully collapsed inside the base.
Figure 32:
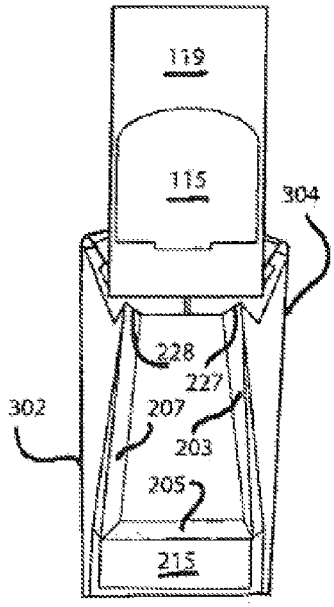
FIG. 32 is a perspective cutaway front view of the inner sleeve fully extended and sitting on double ledge inside the base.
Figure 33:
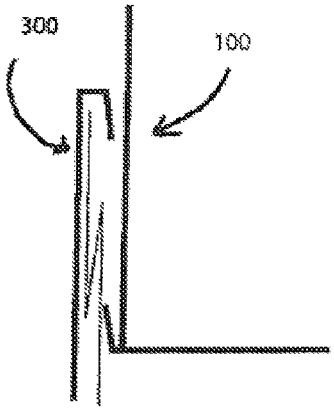
FIG. 33 is a simplified line drawing of the locking mechanism where the inner sleeve catch tab is just below the opening that will allow it to engage the inwardly facing catch tab of the base.
Figure 34:
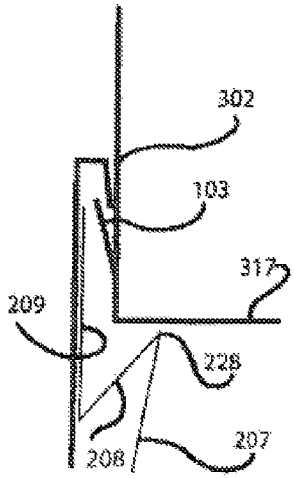
FIG. 34 is a simplified line drawing of the locking mechanism where the inner sleeve catch tab is engaged with the inwardly facing catch tab of the base, and the inner sleeve is resting on the extended ledge, preventing the inner sleeve from sliding into the base.

FIG. 29 shows a close up cutaway front perspective view of the right side of the engaged lock mechanism and the relationship of inner sleeve 100, double ledge 200 and base 300 as the inner sleeve 100 is pulled up from base 300 such that catch tab 104 wedges between catch panel 311 and panel 201 of double ledge 200. It is important to note that the same locking relationship would occur if double ledge 200 did have panel 201. In this instance catch tab 104 would wedge between the interior of catch panel 311 and the interior of base panel 304. It is further important to note that in the case where the inner sleeve 100 and base 300 are made from more permanent materials such as wood, metal plastic and other suitable permanent substrates, the locking tabs including catch tabs 103 and 104 and catch panels 310 and 311, may also be made of the same materials as the inner sleeve and or base, or with mixed materials. Unlike paperboard material, the permanent materials have little or no flex so the relationship and fit between the inner sleeve 100 and the base 300 would need to be such that there would be free movement between a collapsed, or closed, position and expanded, or open, position. However, the choice of materials for the catch panels 310 and 311 and catch tabs 103 and 104 as well as the inner sleeve 100 and base 300, in combination would need to replicate the positions shown in FIGS. 31 and 32, in summary, there will need to be enough flex in the permanent materials to create the same relationships previously described. The inventor acknowledges that there are yet other options in which the positions shown in FIG. 31 and FIG. 32 may be accomplished without having flex built in the more permanent materials. One such example is to use a spring loaded hinge. Another option is shown in FIG. 30 where inner sleeve 100, catch tab 104 and base 300 are made from wood. Rather than sliding the inner sleeve into the base forcing the catch tab to flex UP as it passes catch panel 311 as shown in FIG. 21, FIG. 22 and FIGS. 28A-28B. The wood inner sleeve 100 complete with wood catch tab 104 would be placed inside wood base 300 between panels 207 and 203 of double ledge 200 of FIG. 32. After the wood inner sleeve 100 is fully loaded in the closed position inside base 300, the catch tab 311, which may be made of wood, plastic, metal or other suitable material would attached in position, as shown in FIG. 29, on to base 300 with screws, nails, rivets, glue or other suitable means of attachment such that when the inner sleeve 100 is pulled from base 300 it would engage with catch tab 104 creating the same lock mechanism described previously. FIG. 33 and FIG. 34 are simplified line drawings of FIG. 29 showing the relationship of engagement of the lock mechanism from the left side of the structure. It is also possible that during the assembly process the inner sleeve is slid into the base from the bottom to accommodate non-flexible locking systems such as the wooden one described above.

Figure 35:
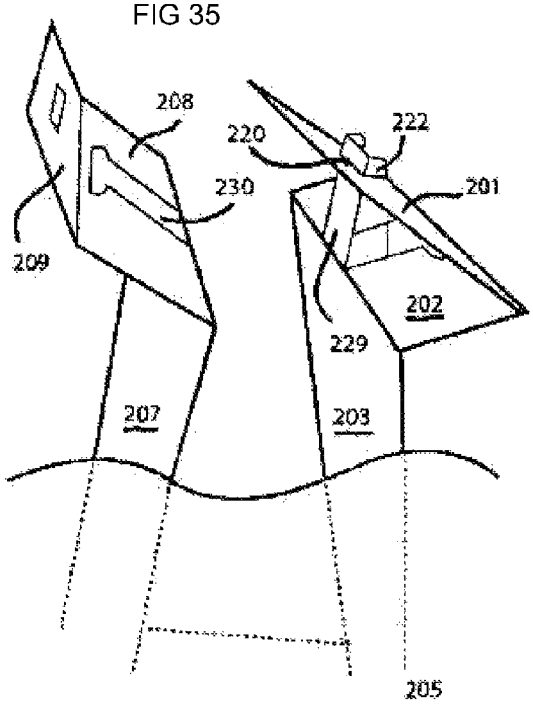
FIG. 35 is a perspective view of the ledge pull tabs, used to pull the ledge close to the base so that the inner sleeve may slide into the base. Pull tab(s) are useful when making retractable versions of this structure.
Figure 36:
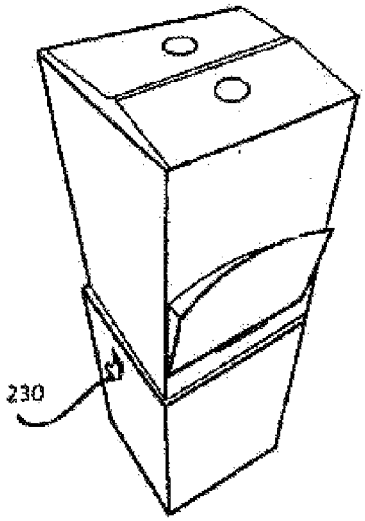
FIG. 36 is a perspective view of the fully assembled structure of FIG. 11 where the pull tab is visible.
Figure 37:
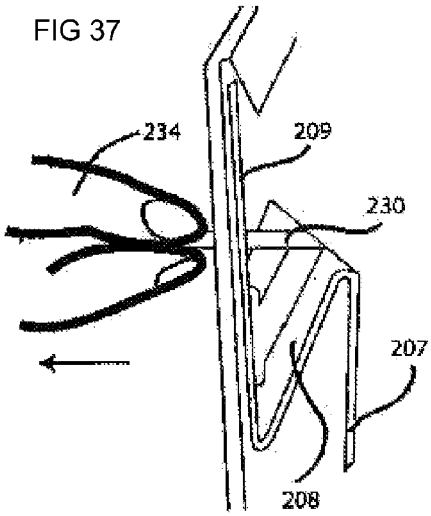
FIG. 37 is a perspective cutaway view of the ledge pull tab being pulled.
Figure 38:
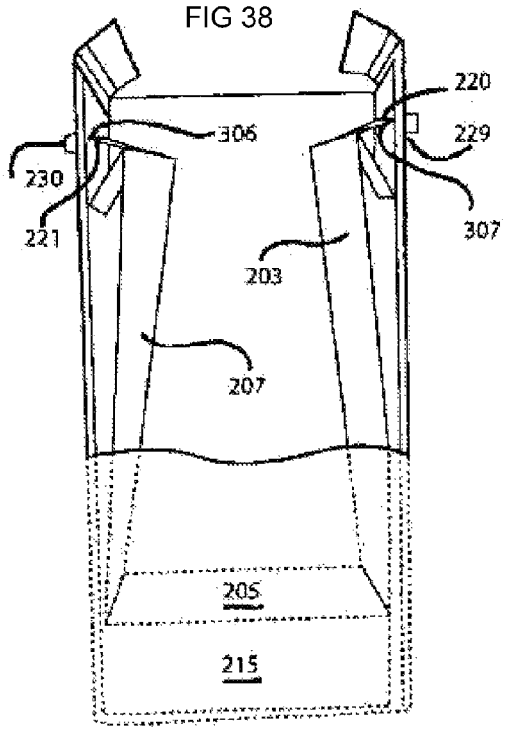
FIG. 38 is a perspective cutaway front view of the expanded ledge, with the pull tabs extending outside the base.
Figure 39:
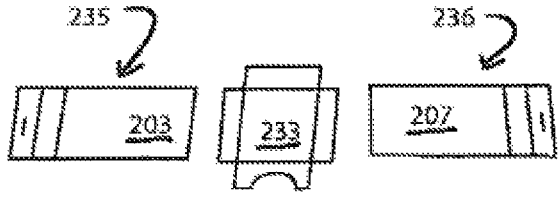
FIG. 39 is a perspective plan view of the double ledge with foot bridge, where the foot bridge is separated from the right and left ledge.
Figure 43:
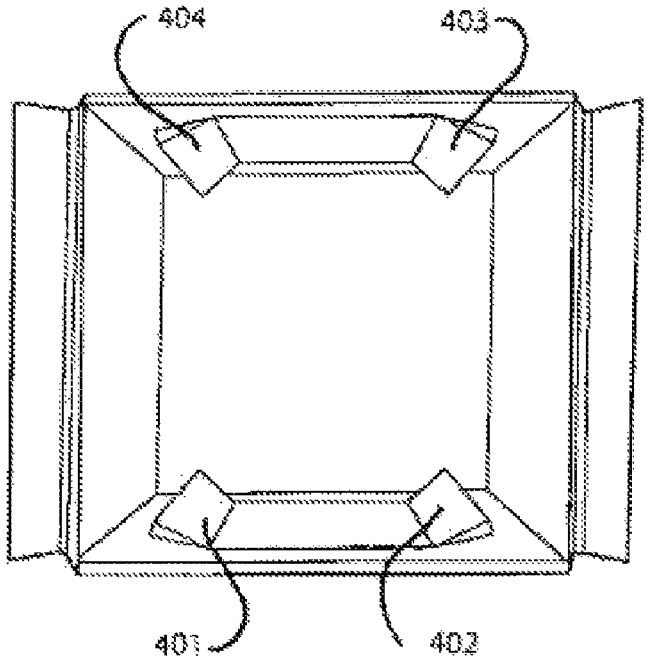
FIG. 43 is a perspective top view of an alternate ledge, made from cut and folded panels of the base.
Figure 57:
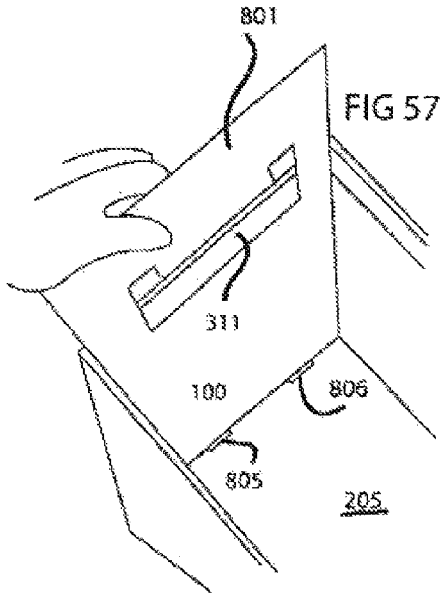
FIG. 57 shows how the Insert Paddle engages with the Base collapsing the Shelf Structure between the Base and the Insert Paddle so that the Product Tray may easily be inserted into the base.
Figure 59A:
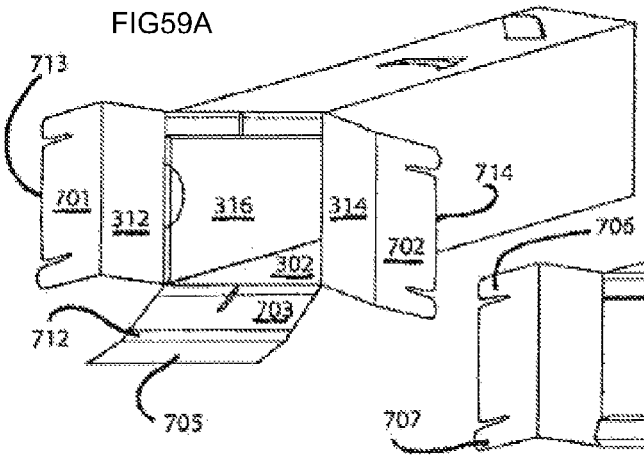
FIGS. 59A-59F are a perspective sequence of drawings that shows a modified Base with flap structures 701,702, 703 and 704 that form a "Foot Bridge" using extended and folded flaps from the base.
Figure 59B:
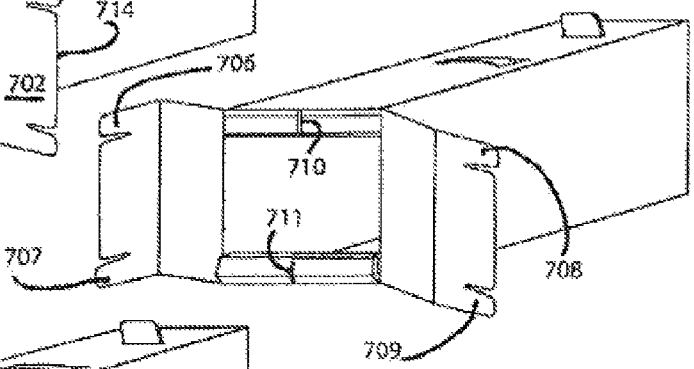
Figure 59C:
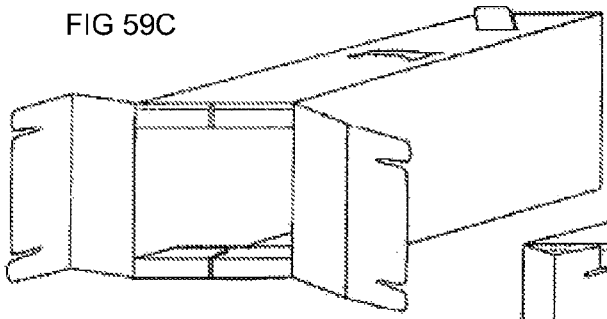
Figure 59D:
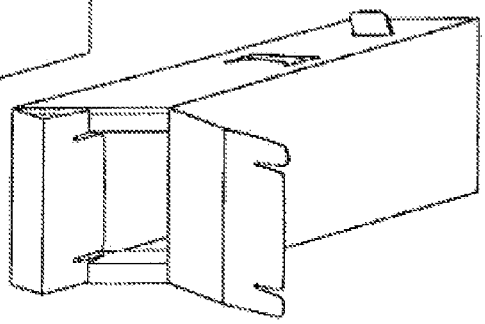
Figure 59E:
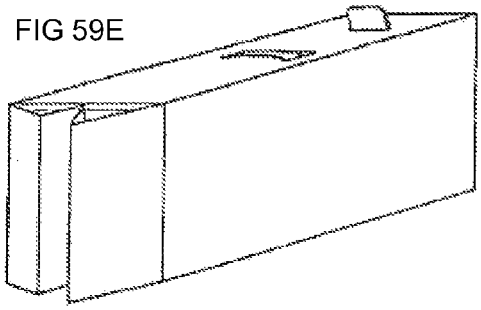
Figure 59F:
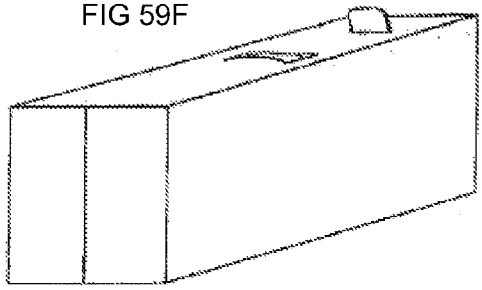

FIG. 35 shows the tab lock system made from panels of the double ledge, designed to hold the compressed panels of the double ledge 200 in position while loading the inner sleeve 100. Without this restraint the tension from the compressed panels of the double ledge would force panels 203 and 207 into the center of the base 300 cavity, making it more difficult to slide the inner sleeve 100 into the base. Another, and for certain applications, more important function of this lock tab system is to allow the structure to easily move from the open to closed position, over and over. This feature makes the structure desirable in uses where both the open and closed positions are important as in a party candy or snack dispenser of FIG. 50. During the party the structure is in the open or UP position. After the party, the structure is easily moved to the DOWN or closed position for storage, until the next party when the structure is yet again moved to the UP position. The lock system is comprised of lock tabs 229 and 230 that pass thru slots 220 and 221 of double ledge panels 201 and 209 and slots 306 and 307 of base 300. In order to easily pass through slots 220, 221 and 306 and 307, the lock tab has flaps 222 that may be folded to easily to pass through the slots, and when unfolded will prevent the tab from slipping inside the base due to the tension caused by the folded of the panels of double ledge 200. Once the tabs are in a locked position and the inner sleeve 100 is in the open, or UP position of FIG. 32, to collapse the display one simply grabs with hand 234, tabs 230 and 229 as shown in FIG. 38 and pulls the tabs away from the base. This action causes the double ledge panels 203 and 205 to move towards the sides of the display creating a cavity such that inner sleeve 100 will easily slide down to fill the cavity created in base 300, thereby creating the closed position of FIG. 31. The inventor suggests that every inner sleeve and base combination will have a slight variation of the precise movement required to adequately release the inner sleeve into the base. For example in the structure of candy dispenser of FIG. 50 a quick uniform jerk of the tabs quite elegantly releases the inner sleeve filled with candy into the base, however, when the inner sleeve is empty, after the tabs a jerked to the right and left the inner sleeve is engaged correctly within the base but will not slide down until it is pushed down, as there is not enough weight in the inner sleeve for self propulsion. By comparison when using the structure as a retail display, of FIG. 22, loaded with heavy product, during assembly, it is easier to release one side of the inner sleeve into the base first then the other side. Here it is also important to note that foot-bridge 233 of FIG. 39 may be made from different material than ledges 235 and 236. For example if a retail display is particularly heavy the foot-bridge may be made from material suitable to hold the weight. If necessary it may be made from solid wood with a cut in foot slot, while ledges 235 and 236 of FIG. 39 may be made from plastic corrugated. It is the intent of the inventor, to have the ability to vary the functionality of the ledge system. For example you may increase or decrease the amount of tension or the strength of the ledges by adding or removing compression panels as shown in FIG. 40, FIG. 41 and FIG. 42. For easier deployment of heavier inner sleeves the compression panels of double ledge 200 may be custom trimmed as shown in FIG. 10B and FIG. 12. The ledges may be made shorter if it is desired to have the inner sleeve reside deeper inside the base when in the open position as shown in FIG. 4. Also, depending on the duration of storage, and or the humidity of where the structure will be deployed, it may be necessary to have the double ledge structure may be made from different flexible materials such as plastic, plastic corrugated, rubber or other suitable materials. Further, as previously described, the ledge structure may be modified to use only a single ledge as shown in FIG. 43. Further the ledge, or double ledge structure may be reversed in how it is folded inside the base (not shown). For example, instead of having compression panels 210, 211, 212, 213 of double ledge 200 reside between ledge panel 203 and base panel 304. Ledge panel 203 may be adjacent to base panel 304, with compression panels 210, 211, 212, 213 of double ledge 200 expand into the cavity of base 300 when the inner sleeve is in the UP position. The advantage of doing this is that the ledge structure has the ability to expand further into the base and under the inner sleeve, providing support more evenly under the inner sleeve, as it is no longer constricted by panels 203. Although this example describes one side of a double sided ledge, the inventor acknowledges that the other side would work the same. When using this ledge structure the tab lock system illustrated in FIG. 36 and FIG. 38 is not the preferred method of inserting the sleeve. What is needed are separate multiple tabs per side, or a separate structure to compress the loose panels, one such system is illustrated in FIG. 57.

Figure 44:
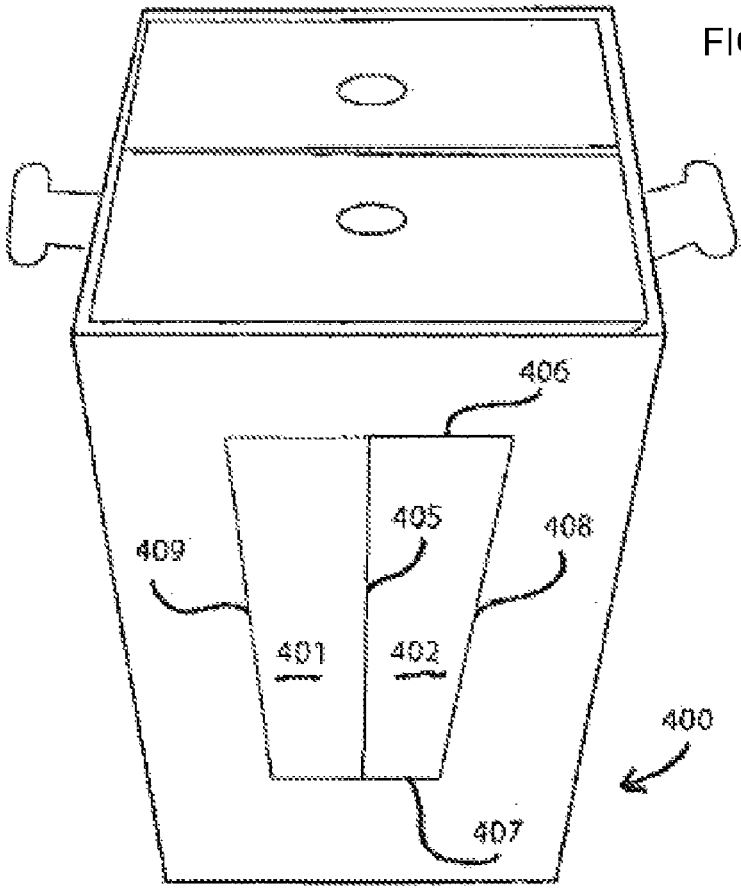
FIG. 44 is a perspective top and side view of the alternate ledge of FIG. 43, showing the cut and fold marks that create the alternate ledge.
Figure 45:
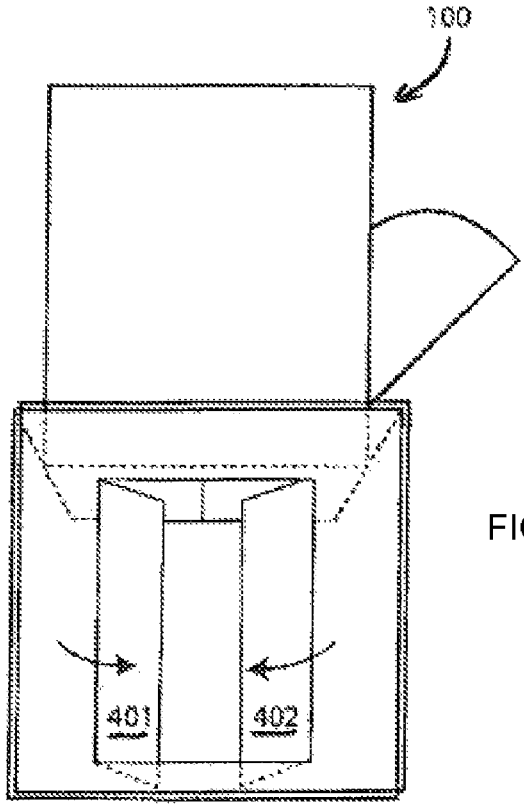
FIG. 45 is a perspective side and bottom view of how the alternate ledge of FIG. 43, engages the inner sleeve.
Figure 46:
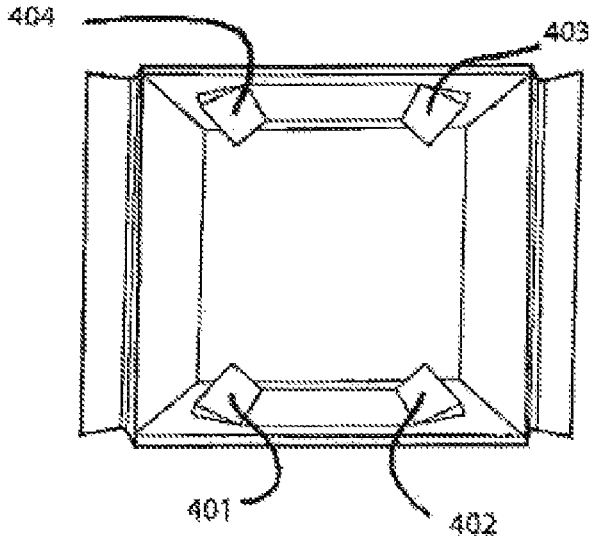
FIG. 46 is the same as FIG. 43 shown with FIG. 45 to help illustrate mechanics of locking mechanism.

It is further the intent of the inventor, to build this structure without the use of a separate ledge structure. It is possible to create the lock mechanism and the positions of FIG. 31 and FIG. 32 without a separate single and/or double ledge system as shown in FIG. 43, FIG. 44 and FIG. 45, where the ledge that holds inner sleeve 100 is created by cut and folded flaps 401, 402, 403, and 404 of base 400. Simply by adding cuts 406 and 407 and folds 408 and 409, flaps 401 and 402 are simply folded inside the base to form the necessary ledge to hold up inner sleeve 100. The locking catch tabs and catch panels of FIG. 22 are still applicable and may be used in conjunction to the folding base flap system of FIG. 45 and FIG. 46. It is important to note that it is the intent of the inventor to vary the flaps to meet the need of the structure. FIG. 46 shows four flaps. This structure may also be successfully accomplished with three, two, or even one flap (not shown).

Figure 47:
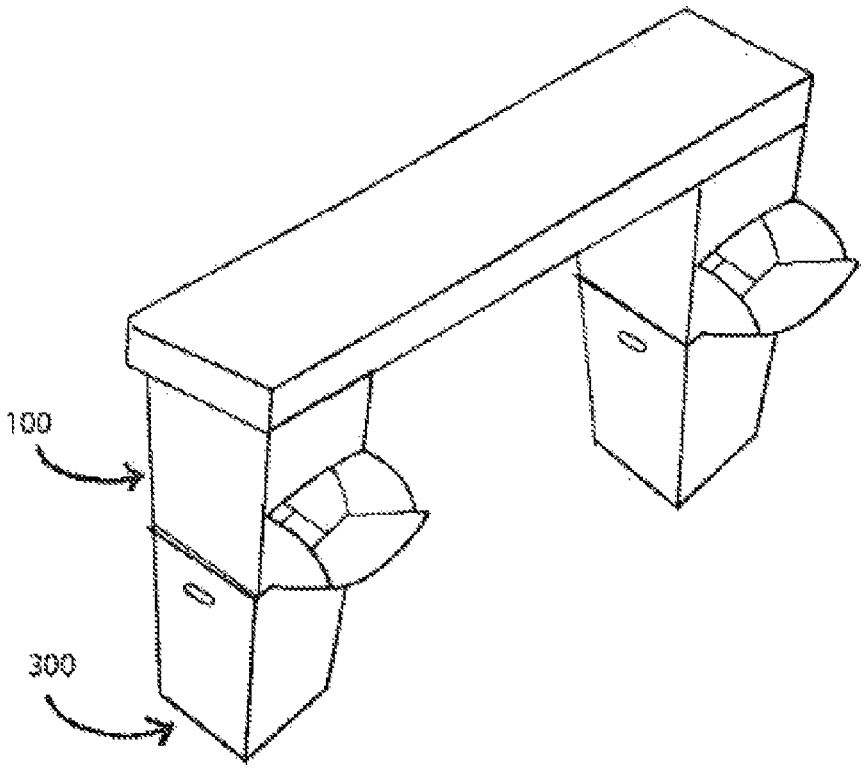
FIG. 47 is a perspective front view of table formed with two structures of FIGS. 28A-28B with a separate table top added.

FIG. 47 illustrates a sampling table made from two slide and lock structures and a tabletop. This would be useful as it serves both as a table and as a storage device.

Figures 48A, 48B:
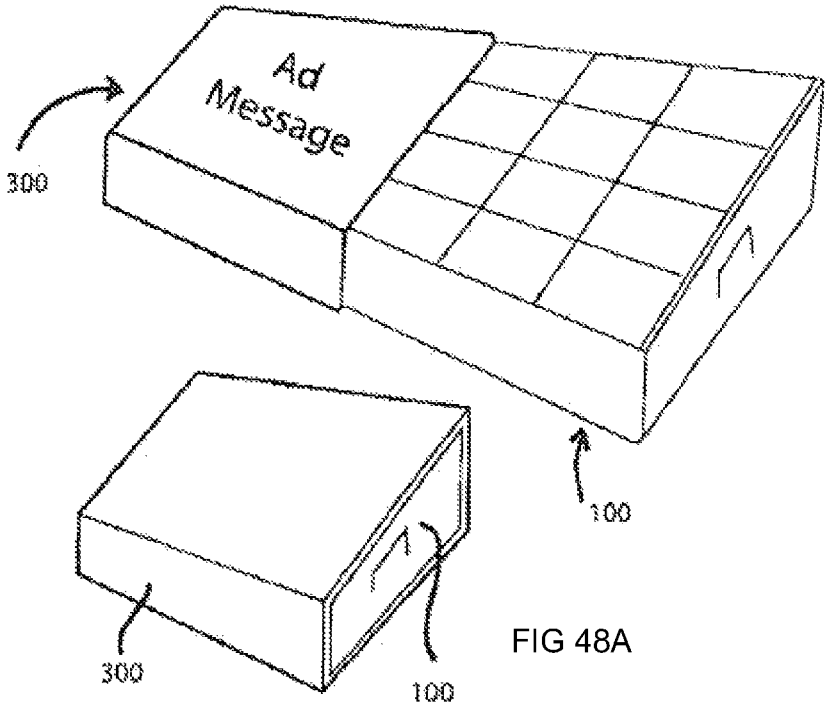
FIGS. 48A-48B are perspective views of a closed and open tray, respectively, that uses the same slide and lock mechanism described in this application.

FIGS. 48A-48B show a PDQ display as used by manufacturers and retailers to showcase products. The advantage of this PDQ display is that it has a closed position that is far smaller than the open position. This means that in the closed position, it will ship at a smaller size, and as a result you will be able to fit a lot more displays per pallet. This means less trucks will be required to deliver the same sized order. Less trucks also means less fuel and less CO2 emissions enabling the world to enjoy a cleaner more sustainable environment. Also it is important to note that in this instance there is practically no weight on the internal ledge structure, as its sole purpose would be to keep the AD MESSAGE panel from collapsing back over the product, rather than like in previous examples where the structure supported the weight of the inner sleeve. Also note that the PDQ display structure has a taller back and a shorter front so as to create a slope so that as the product is shopped from the front rows the product in the rear rows will slide down to the front. It is further the intent of the inventor to use this similar structure as a power wing display (not shown), where the AD MESSAGE panel of FIGS. 48A-48B oriented at the top or the bottom of the display and that hooks are placed at the rear of the display to hag the product for display. Much like the PDQ display, shipping efficiency is critical, so a collapsible structure is a desired option, and one that is well suited for the structure of this invention.

It is further the intent of the inventor not to limit the shape of the structure to a rectangular or square form. The slide and lock structure may be made with mixed materials and in custom shapes, including round, tubular, triangular, and many other even sided or uneven sided structures (not shown).

Figure 49A:
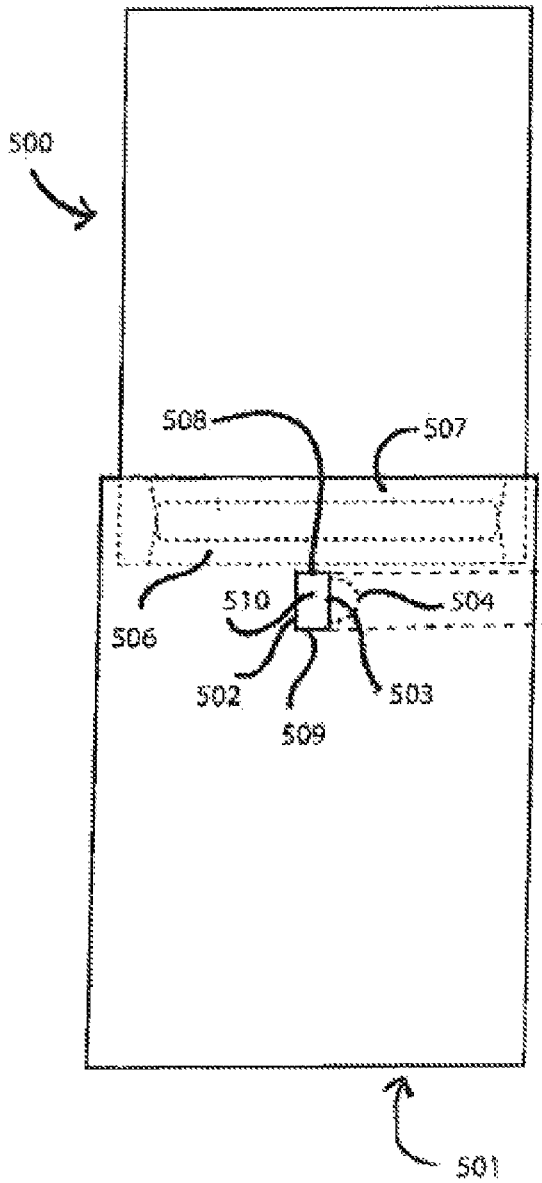
FIGS. 49A-49B are front and side cutaway views, respectively, where the inner sleeve and the base have the dimension of envelopes, where the inner sleeve may be inserted into the base envelope and be extended using the same catch tabs, with or without the folded ledge.
Figure 49B:
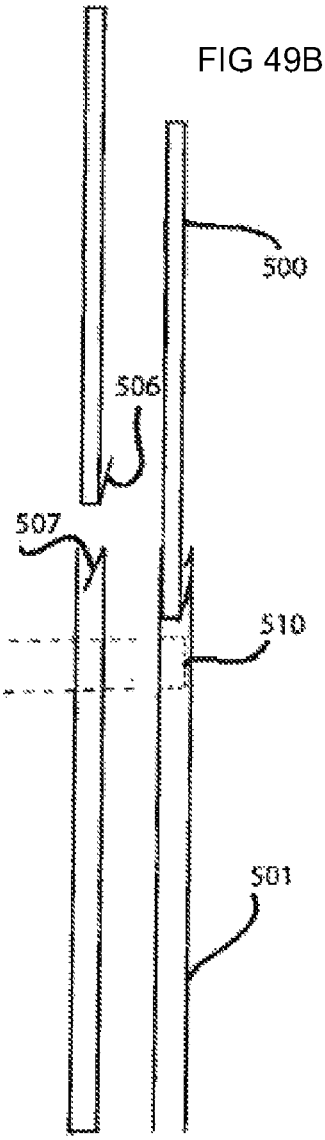

FIGS. 49A-49B show a further embodiment using the slide locking mechanism for a gift card, flat planar display or the like. FIGS. 49A-49B show a flat slide and lock structure with a top card 500 with bottom catch flap 506 that slides into envelope 501 with catch flap 507. the ledge 510 is formed by cuts 502, 508 and 509, and fold 503. Ledge 510 is activated when it is folded 504 inside envelope 501. It is important to note, that the ledge in this case is small since the card will not require a weight-bearing ledge.

FIGS. 50A-50E show the Slide and Lock Display as a retractable candy dispenser of FIG. 25, FIG. 26, FIG. 27, and FIGS. 28A-28B as one that may be used for dispensing Halloween candy. One would purchase the item in a retail store in a collapsed or closed position FIG. 25, then for use, the inner Product Tray 100 would be lifted by handle 114 and 113 at the top of the Product Tray, while a foot is inserted into Foot Bridge 316 (not shown) to ensure Base 300 does not rise when the Product Tray 100 is lifted. During use the Mouth 115 is rotated to open position so as to allow easy access to candy. Once the candy giving event is over, Mouth 115 is rotated to a closed position (not shown) and the Product Tray 100 is released back into Base 300 by pulling outwardly on tab 229 an and tab 230 on the opposite side (not shown) ready for storage until it's next use.

Figure 54A:
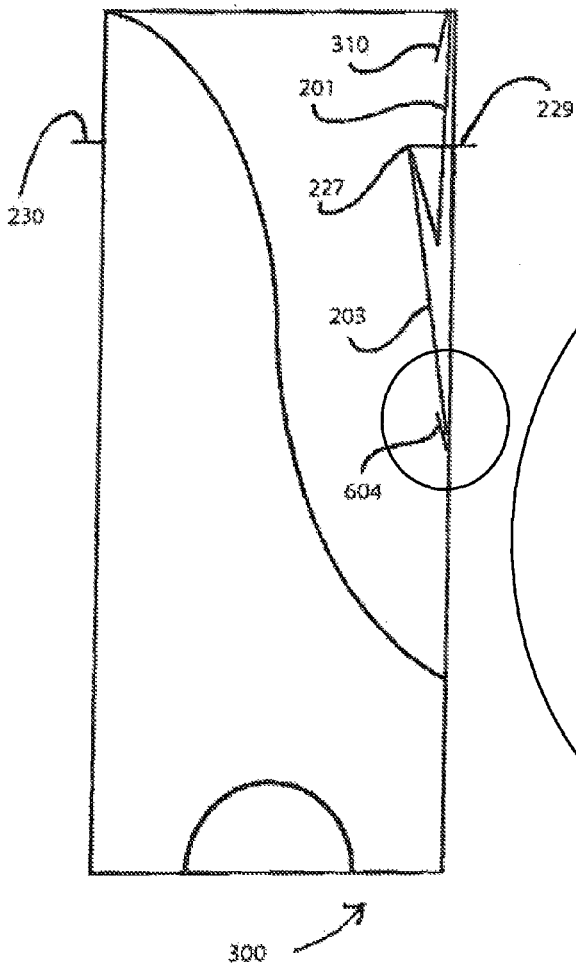
FIGS. 54A-54B are cross-sectional views of the ledge mechanism in FIGS. 53A-53F.
Figure 54B:
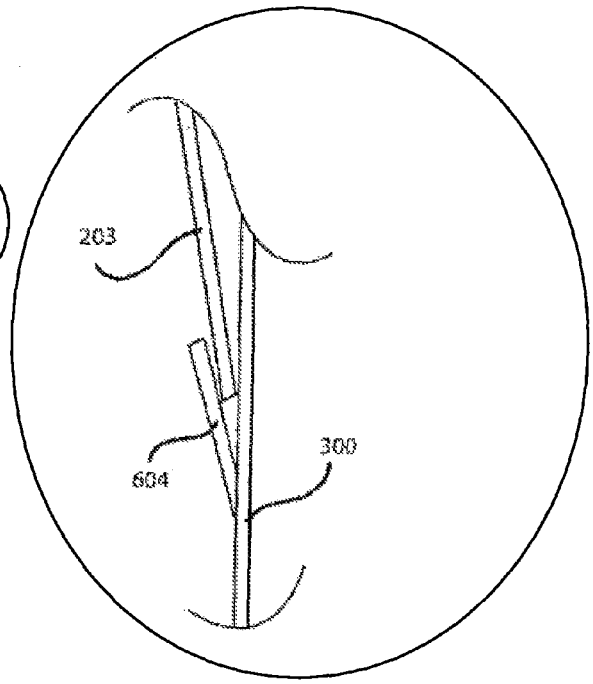
Figure 56:
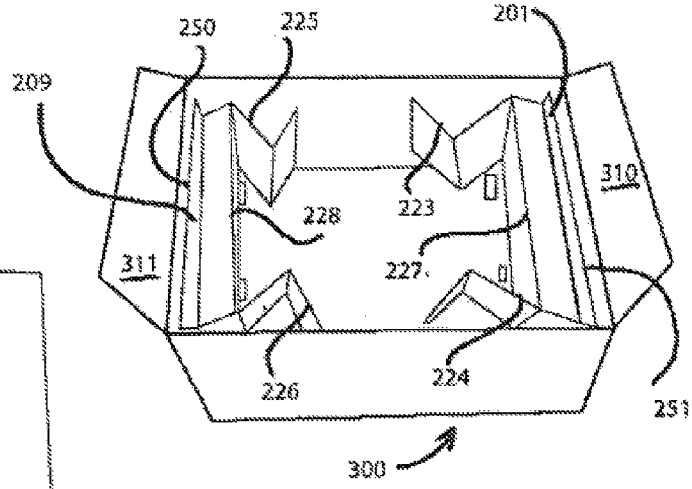
FIG. 56 shows how the modified Shelf Structure of FIG. 12 may be folded so that the flaps are facing inwardly inside the base so that they may extend further into the base when the Product Tray is lifted past the point where the Shelf Structure is activated.

FIG. 51 is a plan drawing of a different embodiment of Base 300. This embodiment includes extended panels 601 and 602 which are modified versions of panels 250 and 251 of FIG. 12 used to form a modified version of the Inner Shelf Structure as shown in FIG. 52. Of particular importance, is that in this modified embodiment, panels 203 and 207 are shortened, and do not reach to the bottom of Base 300, instead the leading edges 607 and 608 are inserted into slots 604 and 603, providing enough support so that shelf edges 227 and 228 will support Inner Product Tray 100. It is important to note that Product Tray 100 in its current embodiment rests on shelf edges 227 and 228, however the Inner Shelf Structure may also be designed such that the Product Tray may rest on the panels 202 and 208 if desired, instead of resting only on the shelf edges. In this instance it is important to note, that if panels will travel upwards during folding, that slots 603 and 604 are designed in such a way that shelf edges 607 and 608 of FIGS. 53A-53B do not slip out while in folded or closed position. Further, It is the intent of the inventor, to allow variations in the structure such that the deployment of the shelf may be varied to accommodate different needs, for example, should there be a need to hide slots 603 and 604 and or slots 306 and 307 from view a separate insert may be made with the slots in the same position on the Insert, rather than in Base 300. This would add the expense of a separate Insert, but would minimize or remove altogether any openings that may interfere with artwork on Base 300. FIG. 56, FIG. 60C and FIG. 61B are examples of such Inserts. Product Tray 650 is a modified embodiment of Product Tray 100 where it is assembled with tuck flaps and does not require gluing. See FIGS. 54A-54B showing the cross-sectional view of the ledge mechanism in FIGS. 53A-53F.

Figure 55:
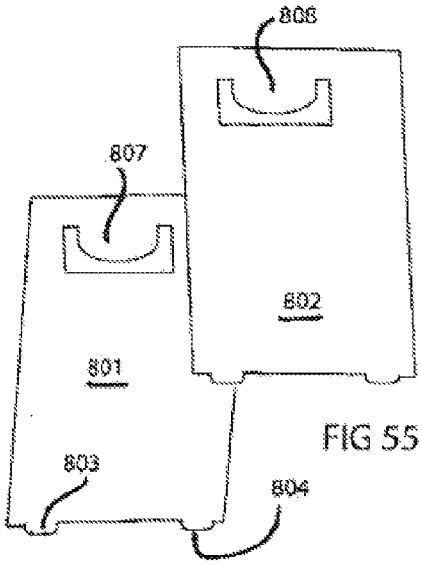
FIG. 55 shows two Insert Paddles used to assist in the placement of Product Tray into base, when using a modified embodiment of Shelf Structure shown in FIG. 12

FIG. 55 is a perspective drawing of two Insert paddles used to help secure Shelf Inserts 803 and 804 inside Base 300 allowing Product Tray 100 to easily be slipped in to Base 300.

FIG. 56 shows modified embodiments of Shelf Inserts 251 and 250 of FIG. 12. These Shelf Inserts expand inwardly inside Base 300 allowing Product Tray 100 to be supported not only on surfaces 227 and 228, but also on surfaces 22, 226, 223 and 224.

FIG. 57 shows Insert Paddle 801 engaged with modified Foot Bridge 205 of FIG. 12. Openings 805 and 806 in Foot Bridge 205 accept tabs 803 and 804 respectively, anchoring the Insert paddle as it collapses Shelf Structure 250 between Insert Paddle 801 and the interior of Base 300. Insert Paddle 801 is locked into position when Tab 807 is pushed over the top edge of Base 300 trapping the inwardly folded flap 311 of Base 300 between the front surface of tab 807 and the rear surface of Insert Paddle 801. This locked position is repeated on the opposite side of Base 300 with Shelf Structure 251 ad Insert Paddle 802. Once both Insert Paddles are fully engaged, and the Shelf Structures 250 and 251 are collapsed, then Product Tray 100 may easily be lowered into Base 300.

Figure 58:
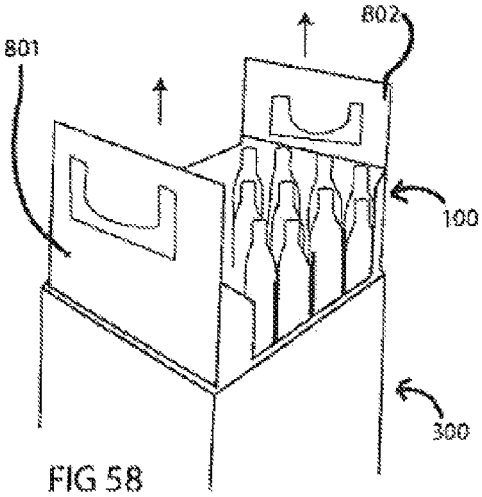
FIG. 58 shows both Insert Paddles being removed after the Product Tray has been placed into the Base.

FIG. 58 shows Product Tray 100 loaded with product inside of Base 300, with Insert Paddles 801 and 802 disengaged from Foot Bridge 205 and being pulled upwards and out of Base 300, Once Product Tray 100 is lifted past surfaces 223, 227 and 224 of Shelf Structure 250 and surfaces 225, 228 and 226 of Shelf Structure 251, then Shelf Structures 250 and 251 will freely expand under Product Tray 100.

FIGS. 59A-59F show a perspective sequence of drawings that show a modified embodiment of Base 300 of FIG. 13 where Flaps 312, 313, 314 and 315 are extended and modified to form a Foot Bridge, eliminating the need to have the Foot Bridge as a separate insert. Locking Tab 701 is added to Flap 312, and Locking Tab 702 is added to Flap 314. Base Flap 313 and Base Flap 315 are replaced by Bridge Flap 703 and Bridge Flap 704. Bridge Flap 703 is formed by rolling Flap 703 inwardly so that outer surface of Panel 705 is adjacent to interior of Panel 302. Bridge Flap 704 is similarly rolled. Once Bridge Flaps 704 and 703 are rolled into position, they are secured with Locking Panels 701 and 702 where tabs 706 and 708, and Tabs 707 and 709 are inserted into slots 710 and 711 of the rolled Bridge Flaps. Once in position, Panels 712 and corresponding panel 715 (not shown), and edges 713 and 714 form a surface that supports Product Tray 100 during shipping or storage. With this modified embodiment, opening 316 is still used to secure the base with a store associates foot as Product Tray 100 is lifted to engage the Slide and Lock Display System.

Figure 60A:
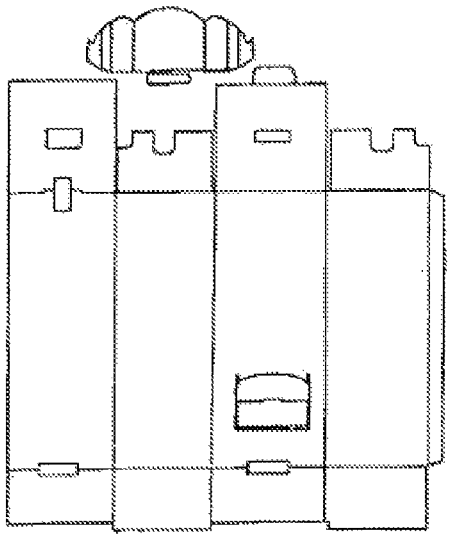
FIGS. 60A-60C show a modified Shelf Structure of FIG. 51 where the Shelf Structure is a separate internal structure that resides inside of the base, eliminating the need for having openings or slits in the Base. Also shown is an attached Foot Bridge.
Figure 60B:
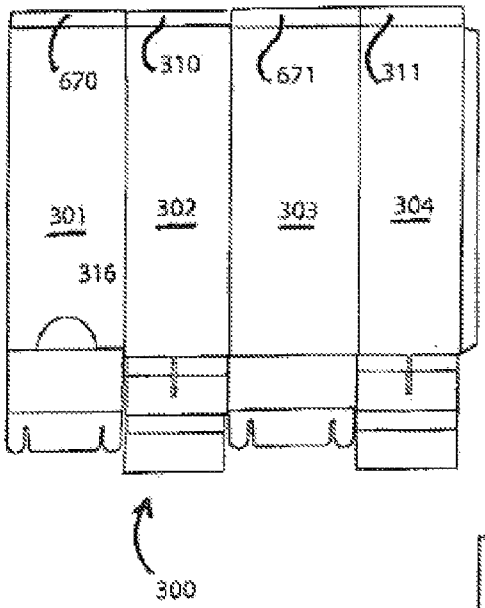
Figure 60C:
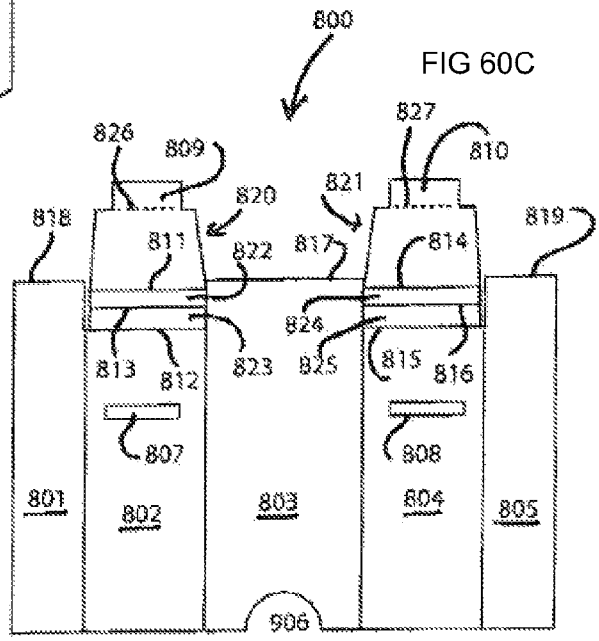

FIGS. 60A-60B show a modified embodiment of Product Tray 100 of FIG. 11 and modified embodiment of Base 300 of FIG. 13, and FIG. 51 where slits 306, 307, 603 and 604 are eliminated from base 300 and catch Flaps 670 and 671 are added to panels 301 and 303 respectively of FIG. 13. Shelf Insert 800 is comprised of panels 802, 803, 804 and optional panels 801 and 805. Panels 820 and 821 are rotated inwardly so that tabs 809 and 810 are inserted into openings 807 and 808. The Shelf ledge is comprised of folded edges 811, 812, 814 and 815. When the Product Tray 100 is inserted into Base 300, Shelf Ledges are collapsed by folding Panels 820 and 821 in such a way that fold 813 is lower than folds 811 and 812 and sandwiched between Panels 822 and 823, and Fold 816 is lower than folds 814 and 815 and sandwiched between panels 824 and 825. With Shelf Insert 800 it is the option of the manufacturer to place the Catch Flaps on Product Tray 100 on any two opposing panels corresponding to the Catch Flaps on Base 300, that when engaged will prevent Product Tray 100 from exiting Base 300. It is the intent of the inventor to allow more than two opposing Shelf Ledges in this configuration. A manufacturer may choose two, three or four Shelf Ledges and one, two, three or four Catch Flaps.

FIG. 61A shows a cross section of Shelf Insert 800 in a "closed" position and FIG. 61B shows a cross section of Shelf Insert 800 in an "open" position where Product Tray 100 is raised past Folds 811 and 814 allowing the Shelf Insert to expand to create a-Shelf Ledge that will support Product tray 100. It is important to note that if 826 and 827 of FIG. 60 are added, then the shelf ledge will expand further inward than if these scores are not included.

FIG. 62 shows how the inclusion of Spring mechanism 828 may be attached or inserted between panels 821 and 804, and between Panels 820 and 802 (not shown).

FIG. 63 shows Spring mechanism of FIG. 62 in expanded or "open" position. It is important to note that the Spring Mechanism may be made from metal, polypropylene, polyethylene, or any other well know suitable material that can provide a flexible Spring Mechanism that will not lose its memory during storage. This addition to the structure may be desired when a display may sit in storage for an extended period of time, where the natural memory of paperboard may not be enough to expand the Shelf Structure as needed. It is Further the intent of the inventor to make the Shelf Insert from materials other than paperboard, such as plastic, corrugated plastic or any other well known materials that would maintain their memory during long periods of storage, or if they are able to offer greater support for heavier products.

Figure 64:
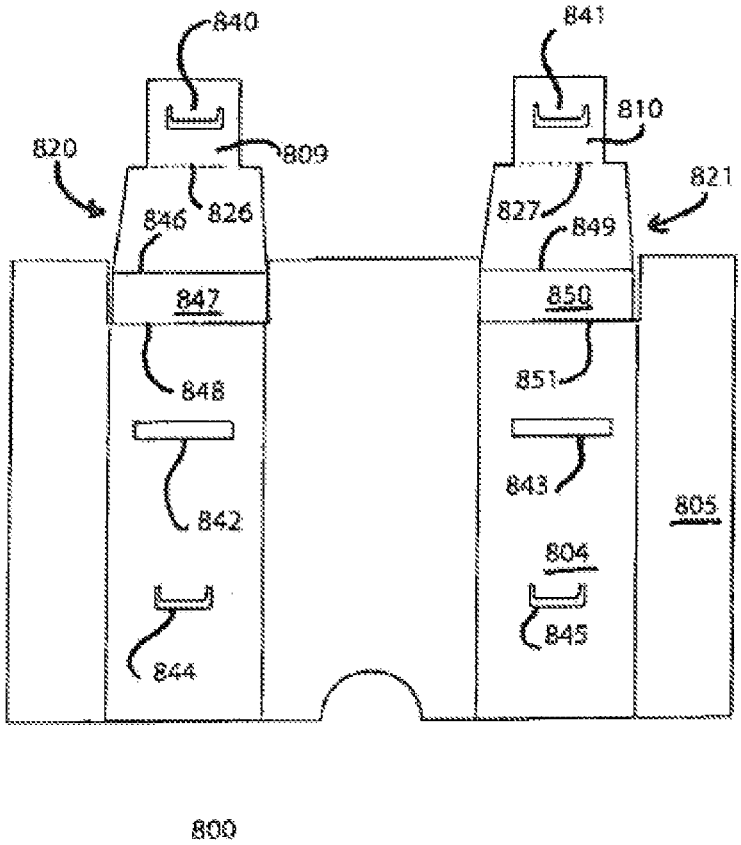
FIG. 64 is a modified Shelf Structure of FIG. 60, where an elastic band mechanism is used to automatically activate the Shelf Structure once the Product Tray is lifted past the Shelf Structure.

FIG. 64 is a modified embodiment of Shelf Insert 800 of FIG. 60C where the shelf structure is modified to allow for the automatic deployment of Shelf Ledges 820 and 821 by elastic means as shown in perspective drawing in FIG. 65

Figure 65A:
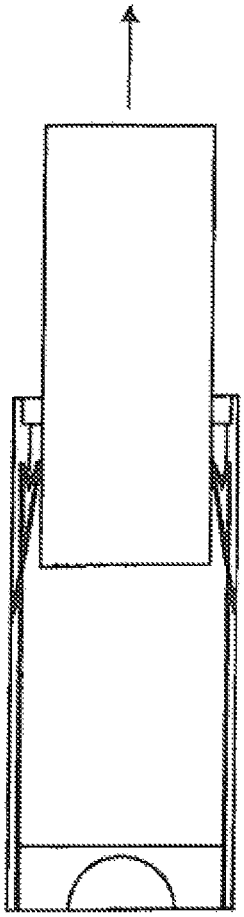
FIGS. 65A-65B are cross section views of a spring mechanism used to automatically propel the internal shelf structure from a "folded" to extended position once the Product Tray is lifted past the Shelf Structure.
Figure 65B:
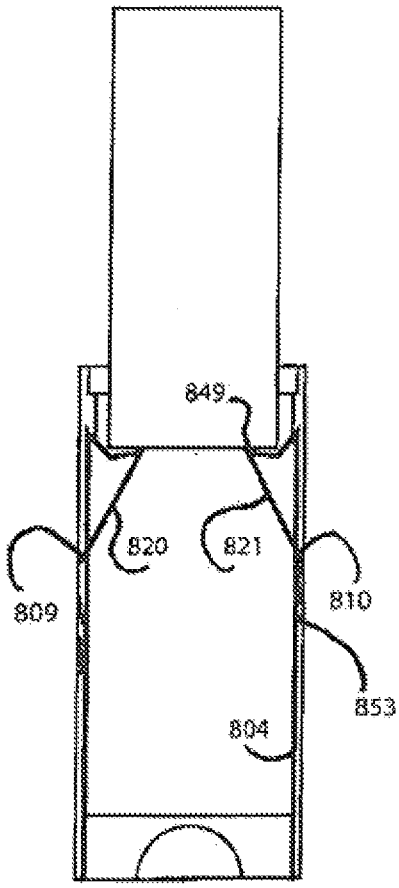
Figure 66:
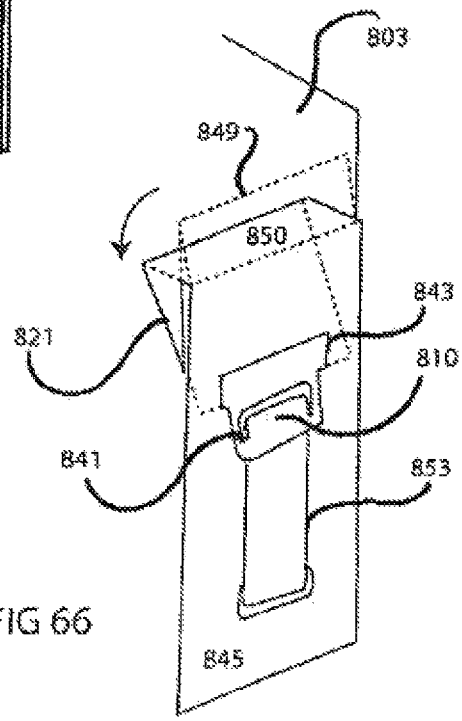
FIG. 66 is a perspective view of the structure in FIGS. 65A-65B.

FIGS. 65A-65B are cross section views of Shelf Insert 800 of FIG. 64 where elastic 853 pulls panel 821 and 820 into an extended position once Product Tray 100 is lifted past Fold 849. It is important to note that when Panels 821 and 820 are in upright or "closed" position Tabs 810 and 809 must protrude past Openings 842 and 843 allowing Elastic 853 to move freely so that panel 821 can quickly be pulled into an extended or "open" position. FIG. 66 is a perspective view of FIGS. 65A-65B.

Figure 67:
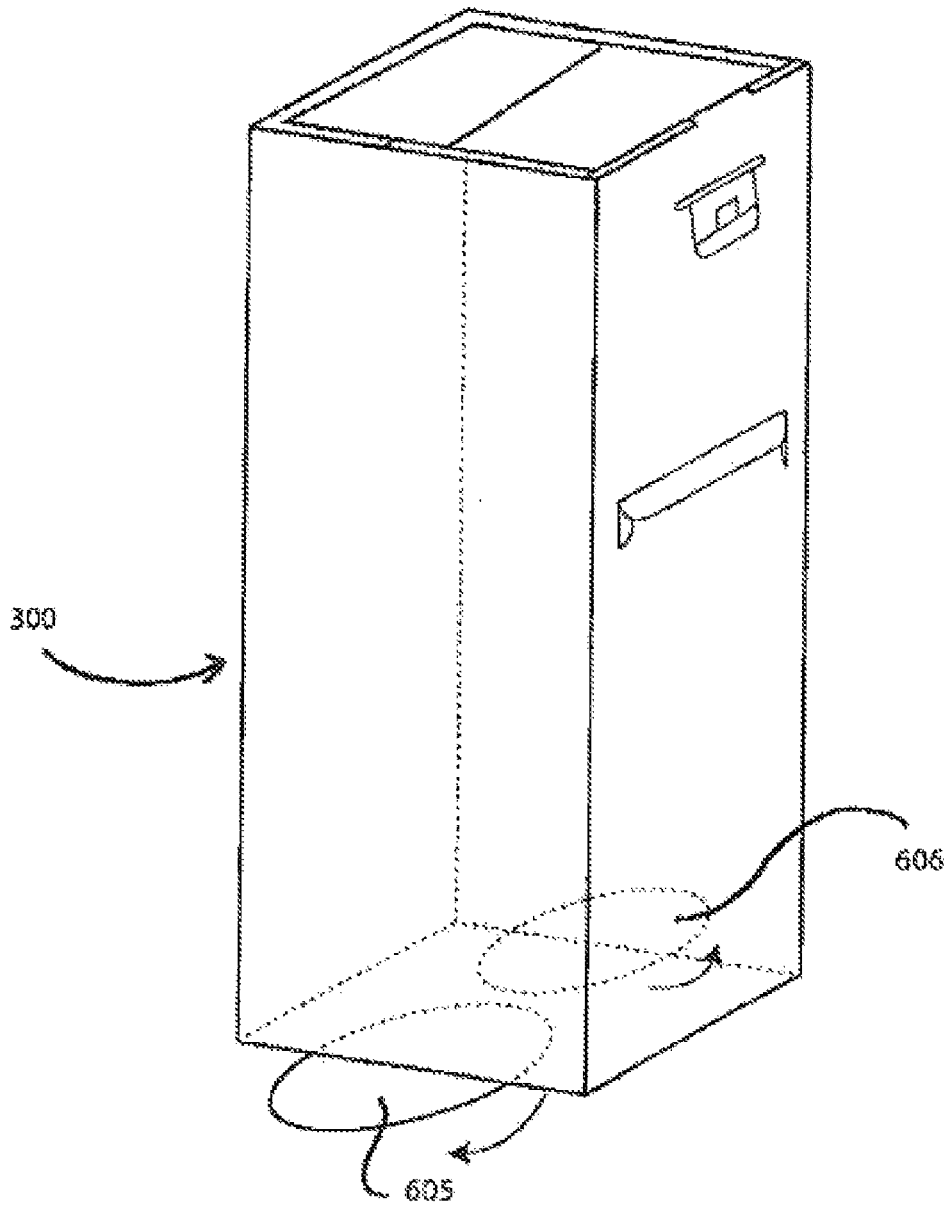
FIG. 67 is a perspective drawing showing the foot pads for holding the base securely while lifting the product tray up into the deployed position.

FIG. 67 shows Base 300 of FIG. 51 where Flaps 605 and 606 replace the need for Foot Bridge 205, and are used to secure Base 300 during the lifting of Product Tray 100. This structure is desirable when a lower cost option is being considered or if there is a need for Product Tray 100 to be filled to maximum capacity, and the extra space used by the Foot Bridge 205 is not necessary.

Figure 68A:
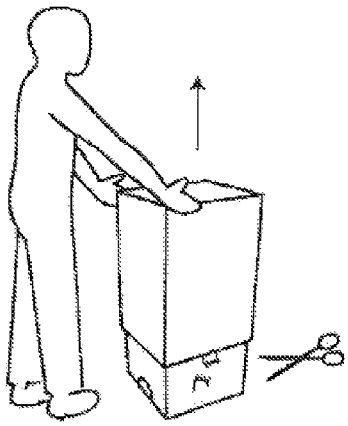
FIGS. 68A-68C are a sequence of drawings showing a user deploying the slide and lock display system.
Figure 68B:
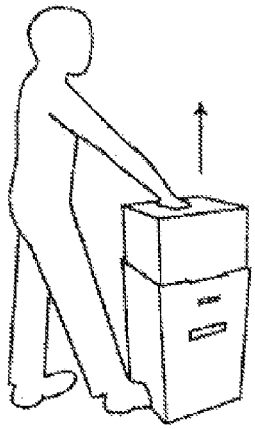
Figure 68C:
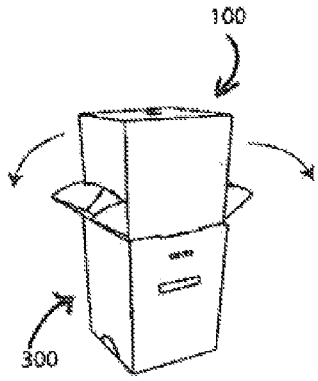

FIGS. 68A-68C show a sequence of steps a Store Associate would go through in setting up a Slide and lock Display System. Store Associate Places their foot into the Foot Bridge 205 (not shown) through slot 316. Then Product Tray 100 is lifted up until the internal shelf Structure 250 and 251 expands from a "closed" to "open" position.

Figure 69:
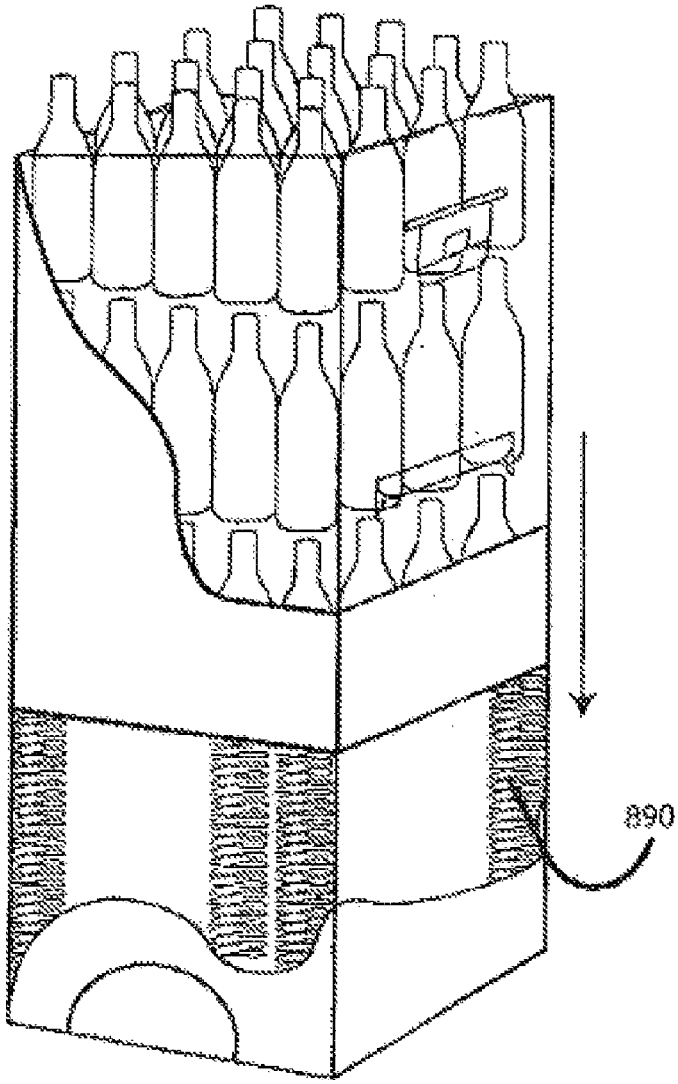
FIG. 69 is a perspective drawing that shows a Product Tray filled with heavy product being lifted with the aid of a spring mechanism.

FIG. 69 is a Slide and Lock mechanism with a Spring Mechanism designed to assist in the lifting of heavy objects. Even though most retailers have a limit of 40 lbs for displays that require lifting, the inventor contemplates the need to have a display that may be significantly heavier and will require additional assistance in lifting.

Figure 70A:
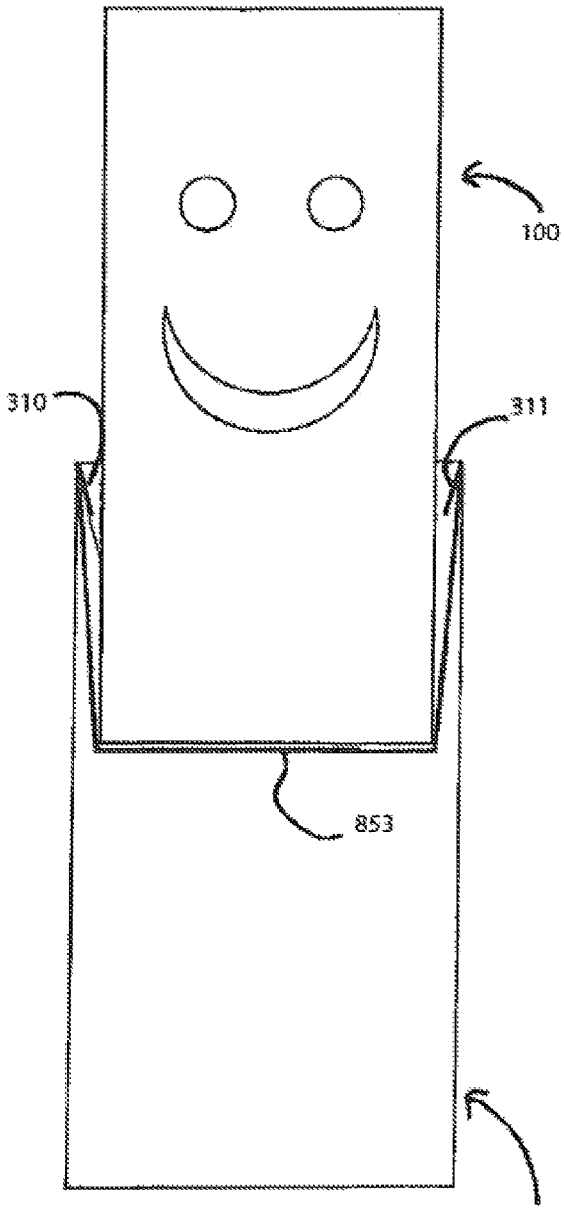
FIG. 70 is line drawing of a Jack-In-The-Box toy that uses a rubber band mechanism to automatically propel the inner carton to an "open" position from a "closed" position.
Figure 70B:
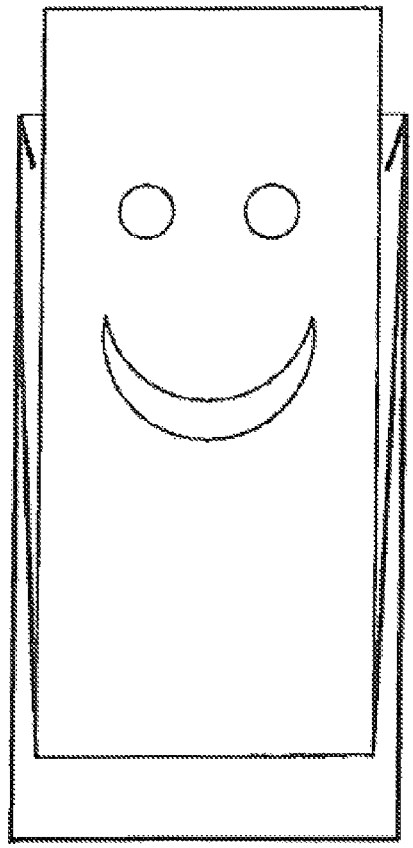
Figure 71A:
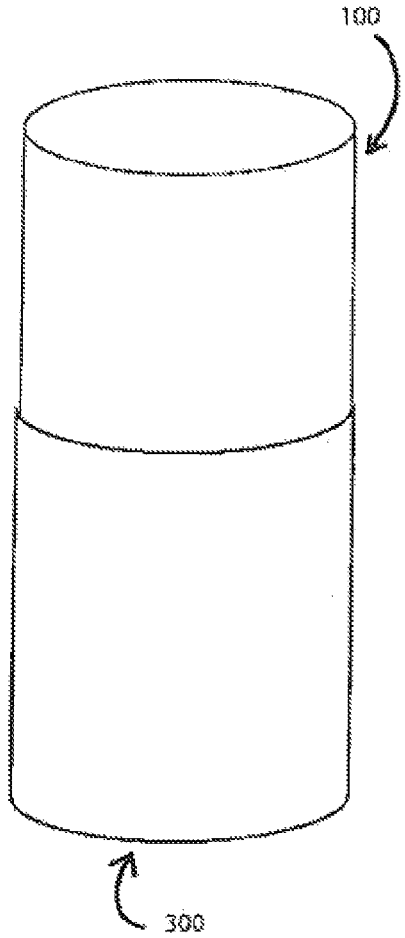
FIGS. 71A-71B are perspective drawings of the Slide and Lock display structure in alternate shapes.
Figure 71B:
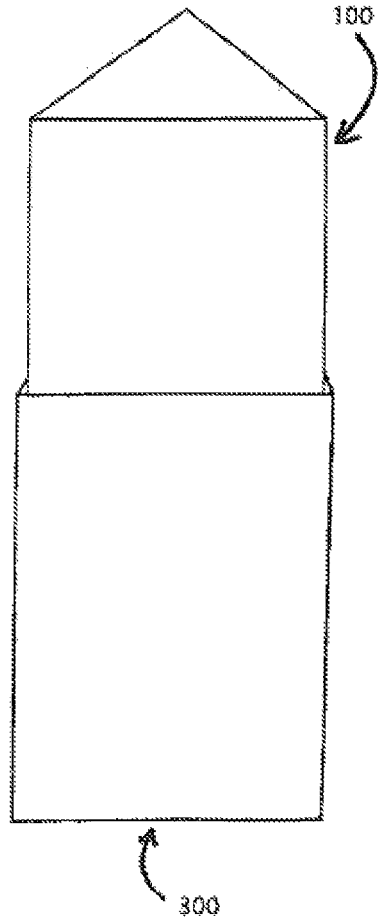

FIG. 70 is a cut away drawing of a Jack in the Box premium that uses elastic 853 to propel Product Tray 100 into an "open" position from a "closed" position FIG. 71 is perspective drawings of the Slide and Lock Display System that takes on different shapes. The inventor contemplates that as long as the structure is able to have Catch Flaps on Product Tray 100 and Catch Flaps on Base 300 that engage once Product Tray 100 moves past the "closed" Shelf Structure and the expandable Shelf Structure resides between Product Tray 100 and Base 300 during shipping or storage, then the structure can take on many shapes.

The invention claimed is:

1. A display structure comprising:

a base for slidably receiving an inner sleeve; the inner sleeve having a substantially similar shape as the base and dimensioned so as to slidably fit within the base; the inner sleeve slidably movable between a closed position and an open position, such that, in the closed position, the inner sleeve is substantially within the base, and in the open position, the inner sleeve is substantially outside the base; and a locking mechanism for securing the inner sleeve in the open position, the locking mechanism including:

at least one ledge configured to prevent the inner sleeve from slidably moving into the closed position; and at least one inner sleeve catch tab and at least one base catch tab, wherein the at least one inner sleeve catch tab and the at least one base catch tab are configured to prevent the inner sleeve from slidably moving out of the base.

2. The display structure of claim 1, wherein the base further comprises a hinged flap to allow access to an interior volume of the base when configured in the open position.

3. The display structure of claim 1, wherein the base further comprises a through hole for receiving a user's foot to secure the base during deployment from the closed position to the open position.

4. The display structure of claim 1, wherein the base further comprises at least one foot tab extending along a distal end of the base for securing the base during deployment from the closed position to the open position.

5. The display structure of claim 1, wherein the base further comprises a spring mechanism mounted inside the base and exerting a force on the inner sleeve, such that the inner sleeve slidably moves from the closed position to the open position under the force of the spring mechanism.

6. The display structure of claim 1, wherein the base further comprises at least one elastic member mounted inside the base and exerting a force on the inner sleeve, such that the inner sleeve slidably moves from the closed position to the open position under the force of the elastic member.

7. The display structure of claim 1, wherein the inner sleeve further comprises a hinged flap to allow access to an interior volume of the inner sleeve when configured in the open position.

8. The display structure of claim 1, wherein the inner sleeve includes a first inner sleeve within the base and telescopically includes a second inner sleeve slidably moveable between a second closed position and a second open position relative to the first inner sleeve wherein the display is fully deployed in response to the first and second sleeves being in the first and second open positions.

9. The display structure of claim 1, wherein the inner sleeve further comprises at least one through hole for manually moving the inner sleeve between the closed position and the open position.

10. The display structure of claim 1, further comprising at least one other display structure and a common support platform wherein each top surface of each inner sleeve of each the display structure provides support for the common support platform.

11. The display structure of claim 1, wherein the base is secured in an upright, horizontal, or upside down manner so that the inner sleeve slidably moves in an upwards, horizontally or in a downwards manner, respectively.

12. The display structure of claim 1, wherein the inner sleeve further comprises an internal storage space adaptable for receiving and securing products for shipping and transport to an end user location.

13. The display structure of claim 1, wherein the display structure is comprised solely from paperboard.

14. The display structure of claim 1, wherein the locking mechanism limits the inner sleeve to a predetermined point maintaining a structural overlap of the base and the inner sleeve.

15. The display structure of claim 14, wherein the locking mechanism further comprises at least one pull tab for releasing the at least one ledge of the locking mechanism, such that the inner sleeve is slidably movable from the open position to the closed position.

16. The display structure of claim 14, wherein the at least one ledge is mounted on an interior surface of the base and automatically extends out from the interior surface in response to the inner sleeve slidably moving to the predetermined point, in the open position, such that the at least one ledge prevents the inner sleeve from slidably moving from the open position to the closed position.

17. The display structure of claim 1, wherein the locking mechanism is comprised solely from paperboard.

* * * * *